US010307793B2

(12) United States Patent
Parr

(10) Patent No.: US 10,307,793 B2
(45) Date of Patent: Jun. 4, 2019

(54) REUSABLE MATERIAL HANDLING DISC FOR RECOVERY AND SEPARATION OF RECYCLABLE MATERIALS

(71) Applicant: Emerging Acquisitions, LLC, Eugene, OR (US)

(72) Inventor: Christopher Parr, Eugene, OR (US)

(73) Assignee: EMERGING ACQUISITIONS, LLC, Eugene, OR (US)

( * ) Notice: Subject to any disclaimer, the term of this patent is extended or adjusted under 35 U.S.C. 154(b) by 108 days.

(21) Appl. No.: 15/357,827

(22) Filed: Nov. 21, 2016

(65) Prior Publication Data

US 2017/0304868 A1 Oct. 26, 2017

Related U.S. Application Data

(60) Provisional application No. 62/326,637, filed on Apr. 22, 2016.

(51) Int. Cl.

| | |
|---|---|
| ***B07B 1/15*** | (2006.01) |
| ***B07B 1/46*** | (2006.01) |
| *B07B 1/14* | (2006.01) |

(52) U.S. Cl.

CPC ..... *B07B 1/15* (2013.01); *B07B 1/4627* (2013.01); *B07B 1/14* (2013.01); *B07B 1/4609* (2013.01)

(58) Field of Classification Search

CPC B07B 1/14; B07B 1/15; B07B 1/4627; B07B 1/4609

USPC ..... 209/659, 660, 663, 667, 673, 674, 930

See application file for complete search history.

(56) References Cited

U.S. PATENT DOCUMENTS

| | | | | |
|---|---|---|---|---|
| 1,899,737 | A | 2/1933 | Ulrich | |
| 4,901,864 | A | 2/1990 | Daughtery | |
| 5,586,832 | A | 12/1996 | Zylka | |
| 6,250,478 | B1 * | 6/2001 | Davis | B07B 1/15 209/314 |
| 6,318,560 | B2 * | 11/2001 | Davis | B07B 1/15 209/667 |
| 6,371,305 | B1 | 4/2002 | Austin | |
| 6,460,706 | B1 | 10/2002 | Davis | |
| 7,434,695 | B2 | 10/2008 | Visscher | |
| 7,549,544 | B1 | 6/2009 | Currey | |

(Continued)

FOREIGN PATENT DOCUMENTS

| | | |
|---|---|---|
| CA | 2720525 | 4/2016 |
| DE | 558516 | 3/1960 |

(Continued)

OTHER PUBLICATIONS

International Search Authority—European Patent Office: International Search Report and Written Opinion dated Jun. 28, 2017 for PCT/US2017/027919; 22 pages.

(Continued)

*Primary Examiner* — Joseph C Rodriguez
*Assistant Examiner* — Kalyanavenkateshware Kumar
(74) *Attorney, Agent, or Firm* — Schwabe Williamson & Wyatt, PC

(57) ABSTRACT

A disc assembly with a substantially rigid disc core includes a first section removably attached to a second section and mounted to a disc screen shaft. The disc core includes a transport surface extending between a left side of the disc core and a right side of the disc core, and a replaceable coating of textured wear material is deposited along the transport surface.

17 Claims, 17 Drawing Sheets

(56) References Cited

U.S. PATENT DOCUMENTS

| | | | |
|---|---|---|---|
| 7,578,396 | B1 | 8/2009 | Garzon |
| 8,424,684 | B2 | 4/2013 | Campbell |
| 2001/0004059 | A1 | 6/2001 | Davis |
| 2006/0226054 | A1 | 10/2006 | Bishop, Jr. |
| 2007/0138068 | A1 | 6/2007 | Davis |
| 2010/0196649 | A1 | 8/2010 | Tennis |
| 2011/0108467 | A1 | 5/2011 | Campbell |

FOREIGN PATENT DOCUMENTS

| | | | |
|---|---|---|---|
| DE | 2751562 | | 5/1979 |
| DE | 102004058898 | | 6/2006 |
| EP | 0773070 | A1 | 5/1997 |
| EP | 2656926 | A1 | 10/2013 |
| FR | 2674776 | | 10/1992 |
| GB | 2357713 | A | 7/2001 |
| GB | 2505521 | A | 3/2014 |
| WO | 2014/019257 | A1 | 2/2014 |

OTHER PUBLICATIONS

European Patent Office, "European Search Report" for EP10190774.
9, dated Aug. 30, 2012, 8 pages.

* cited by examiner

REUSABLE MATERIAL HANDLING DISC FOR RECOVERY AND SEPARATION OF RECYCLABLE MATERIALS

STATEMENT OF RELATED MATTERS

This application claims priority to U.S. Provisional Application No. 62/326,637, filed on Apr. 22, 2016 and entitled Reusable Material Handling Disc for Recovery and Separation of Recyclable Materials; the contents of which are incorporated by reference in their entirety.

FIELD OF THE INVENTION

Material sorting discs and material sorting screen.

BACKGROUND

Disc screens may be used in the materials handling industry for processing large flows of materials and removing certain items of desired dimensions and or shapes. In particular, disc screens may be configured to classify, sort, separate or otherwise distinguish between what may be considered debris or residual materials versus recoverable commodities. Different industries have multitudes of uses for these materials; and what is considered recoverable can vary according to geographical location and the particular application for the screen. The separable materials may consist of soil, aggregate, asphalt, concrete, wood, biomass, ferrous and nonferrous metal, plastic, ceramic, paper, cardboard, or other products or materials which may be recognized as having a relatively lower recoverable value throughout consumer, commercial and/or industrial markets.

The industry standards for known disc screens have primarily been directed to three major areas of design related to the equipment used in the material sorting systems. These include the frame and drive system, the shaft design, and the disc design.

Additionally, known disc screens may be configured to classify material in two distinct ways. A first method of classifying materials may be based on relative size. For example, the disc screen may be configured to separate undersized materials, which may range between one-fourth inches to twelve inches, from oversized materials.

A second method of classifying materials may be based on physical characteristic. For example, known disc screens may be configured to separate two-dimensional objects, such as Old Corrugated Cardboard (OCC), newsprint, office paper, and other fiber materials, from three-dimensional objects, such as plastic jugs, metal containers, and other objects. Material sorting systems may combine multiple methods of classifying material at various stages of processing the material flow.

In known material separation systems, the discs are either welded to the shaft or fastened using bolts or compression fittings. If the discs are fastened on, replacement can be expensive and time consuming; however, the shaft can be reused for a longer period of time. If the discs are welded on, then the entire shaft may require periodic replacement.

Reconfiguring a material processing system to alter the method(s) of separating materials, and/or replacing one or more parts of the equipment due to component failure or wear, may affect the efficiency of operation and add increased costs while the system is not operating. Additionally, worn-out equipment may need to be disposed of or otherwise stored after its useful life is over.

This application addresses these and other problems associated with the prior art.

SUMMARY OF THE INVENTION

A disc assembly is disclosed herein as comprising a substantially rigid disc core including a first section removably attached to a second section and mounted to a disc screen shaft. The disc core may comprise a textured transport surface extending between a left side of the disc core and a right side of the disc core. A replaceable coating of wear material may be deposited along an outer perimeter of the disc core and penetrate into the textured transport surface.

Another example disc assembly is disclosed herein as comprising a substantially rigid disc core including a first section removably attached to a second section and mounted to a disc screen shaft. The disc core includes a transport surface extending between a left side of the disc core and a right side of the disc core, and a replaceable coating of textured wear material may be deposited along the transport surface.

Additionally, a disc assembly is disclosed herein, as comprising a first disc including a first transport surface located along an outer perimeter of the first disc and associated with a first diameter, and a second disc having a second diameter and including a transport surface extending between a left side of the second disc and a right side of the second disc. The second diameter may be larger than the first diameter. A replaceable coating of textured wear material may be deposited on the transport surface.

A method is also disclosed herein. The method may comprise attaching a first portion of a disc assembly to a second portion of a disc assembly in order to mount the disc assembly to a shaft. The disc assembly may comprise a coating of wear material applied to the disc assembly. The method may further comprise separating materials transported over the disc assembly, and detaching the disc assembly from the shaft in response to a thickness of the wear material being decreased during material separation. The coating of wear material may be reapplied on the disc assembly in order to reuse the disc assembly. Additionally, the wear material may be textured.

In some examples, the disc assembly may comprise a disc core and a textured transport surface extending between a left side of the disc core and a right side of the disc core. Reapplying the coating may comprise depositing the wear material along an outer perimeter of the disc core. The wear material may penetrate into the textured transport surface. Additionally, the coating of wear material may comprise a substantially non-rigid wear material that penetrates into the textured surface of a substantially rigid disc core of the disc assembly.

The foregoing and other objects, features and advantages of the invention will become more readily apparent from the following detailed description and accompanying drawings.

DETAILED DESCRIPTION

Solid Waste recovery pertains to the ability to separate for recycling or re-use a multitude of materials and products once they have reached the end of their life cycle. Solid Waste can include typical recyclable material including but not limited to Municipal Solid Waste (MSW), Refuse Derived Fuel (RDF), Construction and Demolition (C&D) or Residential Single Stream. These different kinds of Recoverable Solid Waste can include but is not limited to, fiber material such as newspaper, mixed paper, Old Corrugated Cardboard (OCC), other cardboard and office paper product; light plastic containers and film plastic, aluminum containers, tin containers and other containers or materials with two or three dimensional shapes; as well as wood and aggregate.

Some of the MSW can be used for making new products that may use the same material as the recycled items. For example, the paper and cardboard fiber material can be re-pulped to make new paper, cardboard or other fiber products. The recyclable MSW, such as plastic containers, can be shredded and melted into new containers and other types of plastic products that may not be related to the original recovered product. For example, PET bottles can be used as fiber fill for winter jackets or as fill for mattresses.

Most of the material stream, whether two-dimensional or three-dimensional objects, may be recovered and used for making new products or used as an energy source. The ability of a disc screen to efficiently separate by size and physical characteristic may significantly limit the amount of contaminant found in the final recovered commodity.

Equipment used in material sorting systems may include fairly heavy duty components with an associated cost per ton of material used. The ability to reduce the cost per ton can similarly reduce the cost of manufacturing and/or reduce the cost of maintenance associated with the system. Despite being made out of steel or other types of metal, material sorting discs in particular may be subject to considerable wear and require relatively frequent replacement over the life of the material separation system.

Figure 1:
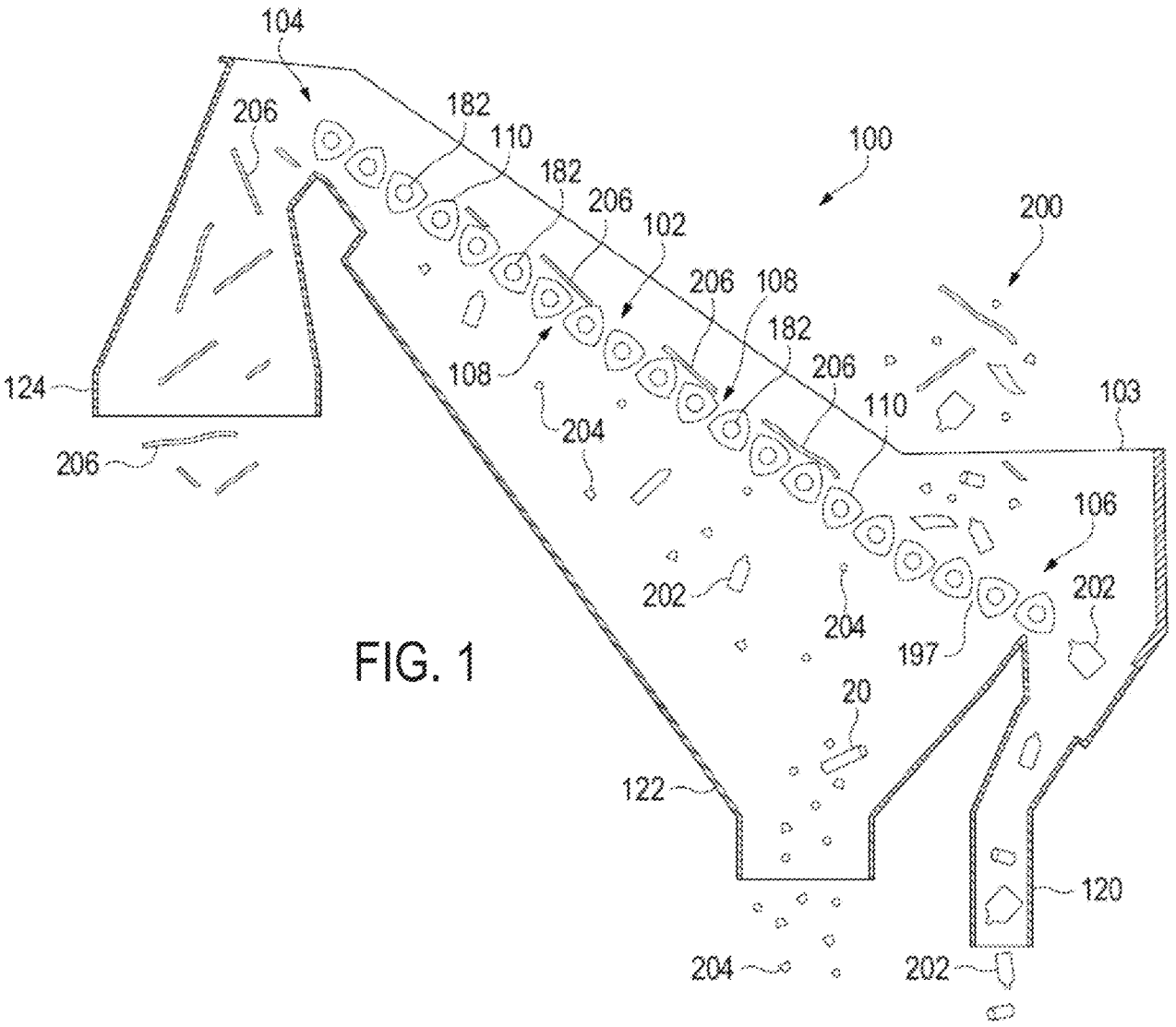
FIG. 1 illustrates a side sectional view of an example material separation system.

FIG. 1 illustrates an example separation system 100 configured to separate recyclable two-dimensional fiber materials from other three dimension materials such as recyclable plastic and metal containers. The separation system 100 includes a frame 103 that supports a disc screen 102. The disc screen 102 includes shafts 182 that attach to the frame 103 and multi-diameter disc assemblies 110 that attach to the shafts 182. The shafts 182 and disc assemblies 110 may be rotated in unison by a motor. The disc screen 102 may be orientated at an upwardly inclined angle from an in-feed end 106 to an out-feed end 104. A portion of the disc screen 102 is shown in more detail below in FIG. 2.

The disc screen 102 may be configured to sort recyclable items from a comingled MSW stream 200. Smaller objects and residue 204 typically falls through InterFacial Openings (IFOs) 108 formed between the disc assemblies 110. The objects and residue 204 drop through the disc screen 102 and into a central chute 122. Other flatter and larger fiber material 206, such as paper and OCC, may be transported by the disc assemblies 110 over the top out-feed end 104 of disc screen 102 and dropped into a chute 124. Containers and other more three dimensional shaped objects 202, such as plastic and metal bottles, cans, jugs, other containers, etc. either fall through the IFOs 108 in the disc screen 102 and into chute 122 or tumble backwards off the back in-feed end 106 of the disc screen 102 into a chute 120.

Figure 2:
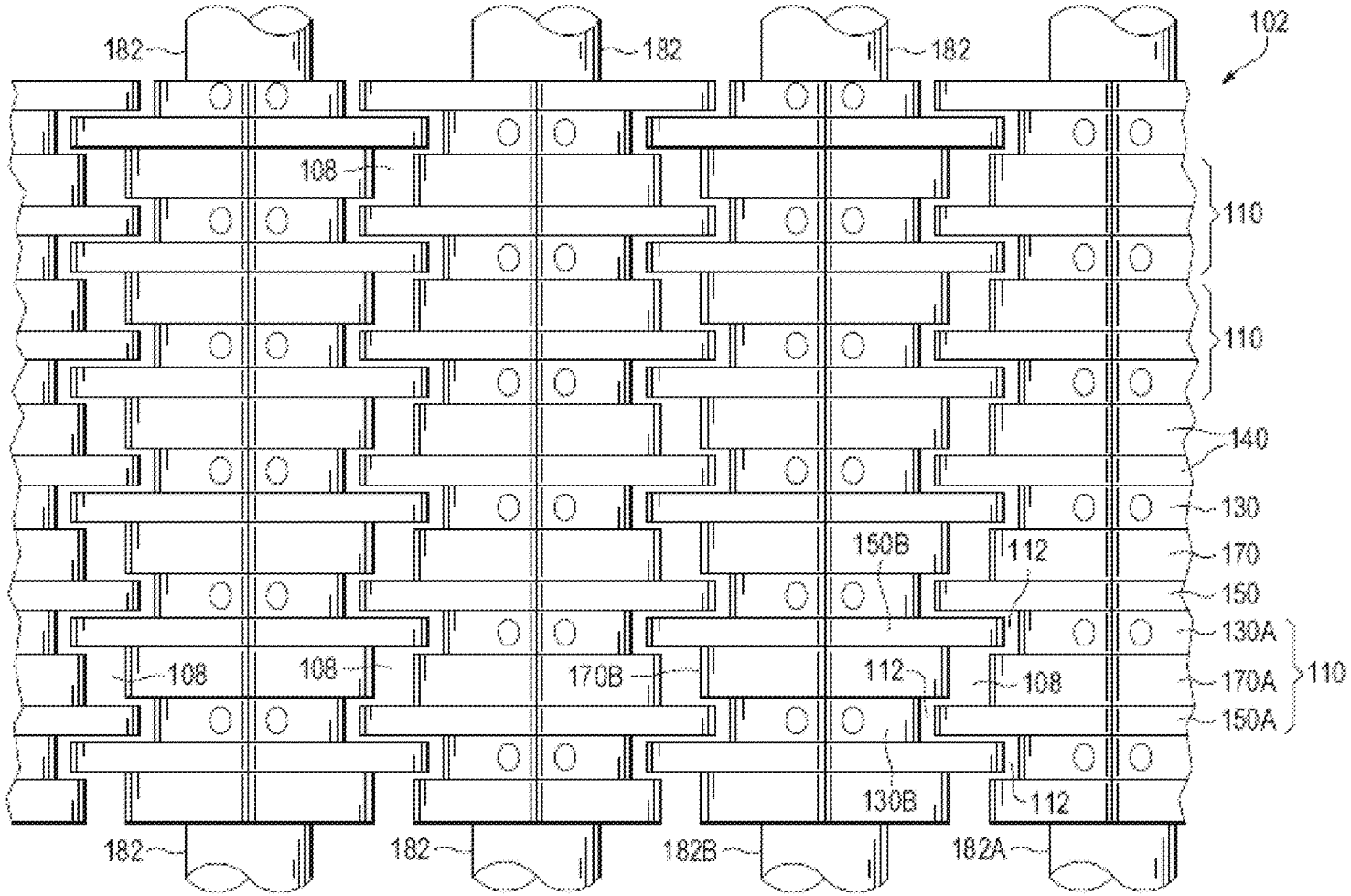
FIG. 2 illustrates a more detailed top view of example multi-diameter disc assemblies.

FIG. 2 illustrates a section of the example disc screen 102 of FIG. 1. Referring to both FIGS. 1 and 2, the disc screen 102 includes shafts 182 mounted to the sidewalls of frame 103 in a substantially parallel relationship. Each multi-diameter disc assembly 110 may comprise a small diameter spacer disc 130, an intermediate diameter disc 170, and a larger diameter large disc 150. The large diameter disc 150 and an associated intermediate diameter disc 170 in the same disc assembly 110 may alternatively be referred to as a compound disc 140 and in some examples, may be formed from a same unitary piece of rubber. In other examples, the compound discs 140 may be made from some material other than rubber, such as steel or a relatively hard resin. Additionally, compound discs 140 may be formed from a different type of material than the spacer discs 130 and may be mounted to the shafts 182 separately from the spacer discs 130.

The multi-diameter disc assemblies 110 may be aligned laterally on the shafts 182 so that the discs assemblies on adjacent shafts 182 overlap in a stair step manner as shown in FIG. 2. For example, the large diameter disc 150A is aligned laterally on the shaft 182A with the small diameter spacer disc 130B on shaft 182B. The intermediate discs 170A and 170B are aligned with each other on adjacent shafts 182A and 182B, respectively. The small diameter spacer disc 130A on shaft 182A is aligned with the large diameter disc 150B on adjacent shaft 182B.

During rotation, the disc assemblies 110 on adjacent shafts 182 may be configured to maintain a substantially constant spacing. The space between adjacent intermediate diameter discs 170A and 170B form one of the inter-facial openings (IFOs) 108 that remain substantially constant during disc rotation. The IFOs 108 allow smaller sized objects 204 to drop through the disc screen 102 while some of the material 206 is transported up the disc screen 102. The spaces between the large diameter discs 150 and small diameter spacer discs 130 on adjacent shafts 182 form secondary slots 112. The secondary slots 112 may be configured to remain at a substantially constant size during disc rotation.

The alternating alignment of the smaller spacer discs 130, large discs 150, intermediate discs 170 both laterally across each shaft 182 and longitudinally along the disc screen 102 between adjacent shafts 182 may be configured to eliminate long secondary slots that would normally extend laterally across the entire width of the disc screen 102 between discs on adjacent shafts 182. Large thin materials 206, such as paper and cardboard, cannot easily pass through the secondary slots 112 or IFOs 108. This allows the materials 206 to be carried up the disc screen 102 and deposited in chute 124 with other recyclable MSW fiber materials.

In some examples, openings 108 are around 2 inches by 2 inches but different dimensions cam be used for different material separation applications. For example, the size of IFO openings 108 can vary according to the market for the fines material 204 which can differ according to region. In other types of news sorter screens, the openings 108 may be larger, such as 3.25, 4.25, or 5.25 inches by 5 inches.

Referring still to FIGS. 1 and 2, the different discs 130, 150, and 170 may be configured to function differently during the separation of material stream 200 and therefore exhibit different wear patterns. For example, the large diameter discs 150 extend out above the intermediate and small diameter discs 170 and 130, respectively. Accordingly, the large diameter discs 150 may be configured to take on much of the task of transporting material 200 up disc screen 102.

The large diameter discs 150 also may be configured to absorb much of the initial contact of the materials that are dropped and then fall back off the back end 106 of disc screen 102. For example, the three-dimensional containers 202 in material stream 200 are dropped onto the counter-clockwise rotating large discs 150 in FIG. 1 and tumble back over the back end 106 of disc screen 102 into chute 120.

The large diameter discs also may be configured to provide much of the up and down agitation of the MSW material 206 carried up the screen 102. Because of the large amount of contact with material 200, the larger discs 150 tend to have their cross sectional area reduced at a faster rate than the other smaller diameter discs 170 and 130.

As explained above, the intermediate discs may be configured to form the IFOs 108 between adjacent shafts 182. However, in other example systems, such as a news sorter or a Debris Roll Screen (DRS), the IFO may be primarily created by the shaft and not the shape of the disc. In still other examples, the IFO may be created by a combination of shaft, spacer, and/or disc configurations. Sorting systems comprising a variable IFO are described in U.S. Pat. No. 8,991,616 entitled Material Sorting Disc with Variable Interfacial Opening, the contents of which are herein incorporated by reference in their entirety.

As shown in FIG. 1, the smaller diameter materials 202 fall through the IFOs 108 while being carried up screen 102. Although to a lesser extent than the large discs 150, the intermediate discs 170 also may be configured to transport some of the materials 206 up the screen 102 and contact, rotate, and cause some of materials 202 to fall off the back end 106 of screen 102. The intermediate diameter disc 170 may be configured to contact less of the material stream 200 than the large diameter discs 150 and therefore their cross sectional area may be reduced at a slower rate than the large discs 150.

The spacer discs 130 may have a smaller outside diameter than both the large discs 150 and the intermediate discs 170. Accordingly the spacer discs 130 may be configured to come in much less contact with material stream 200 and transport relatively little of the material 206 up the screen 102. Rather, in some examples, the primary function of the spacer discs 130 may be to form the thin secondary slots 112 with the large discs 150 on adjacent shafts that are offset from the laterally adjacent IFOs 108. As explained above, the secondary slots 112 may be configured to prevent relatively flat materials 206, such as paper and OCC, from dropping through the screen 102.

In some examples, the large discs 150 and intermediate discs 170 may be made out of a softer rubber material to better grip, transport, and separate out different parts of MSW material stream 200. Rubber discs often grip MSW materials 206 better than a hard steel disc and therefore may be more effective at separating the MSW material 200.

Figure 3:
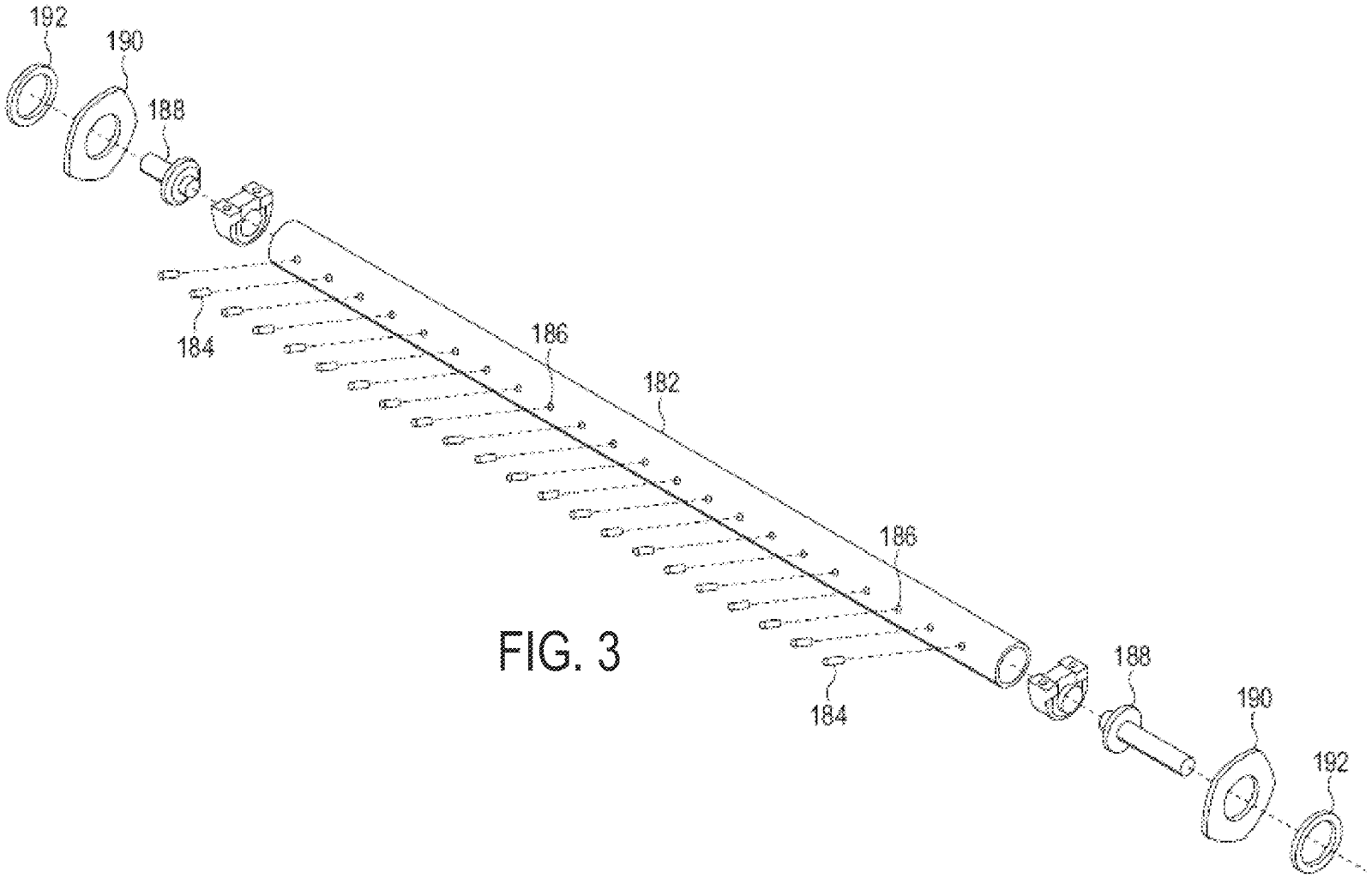
FIG. 3 illustrates an isolation view of an example shaft.
Figure 4:
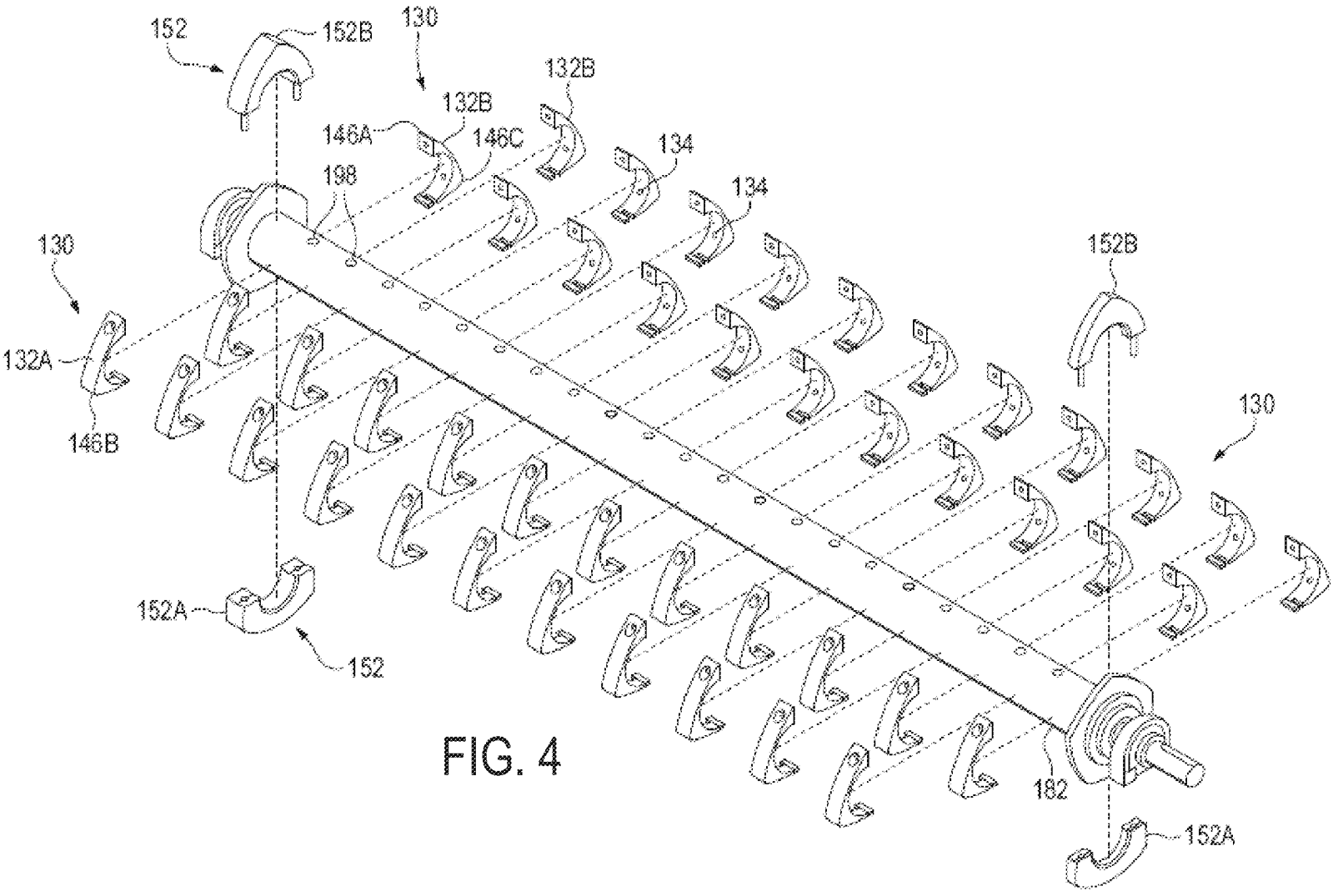
FIG. 4 illustrates the example shaft of FIG. 3 with spacer discs.
Figure 5:
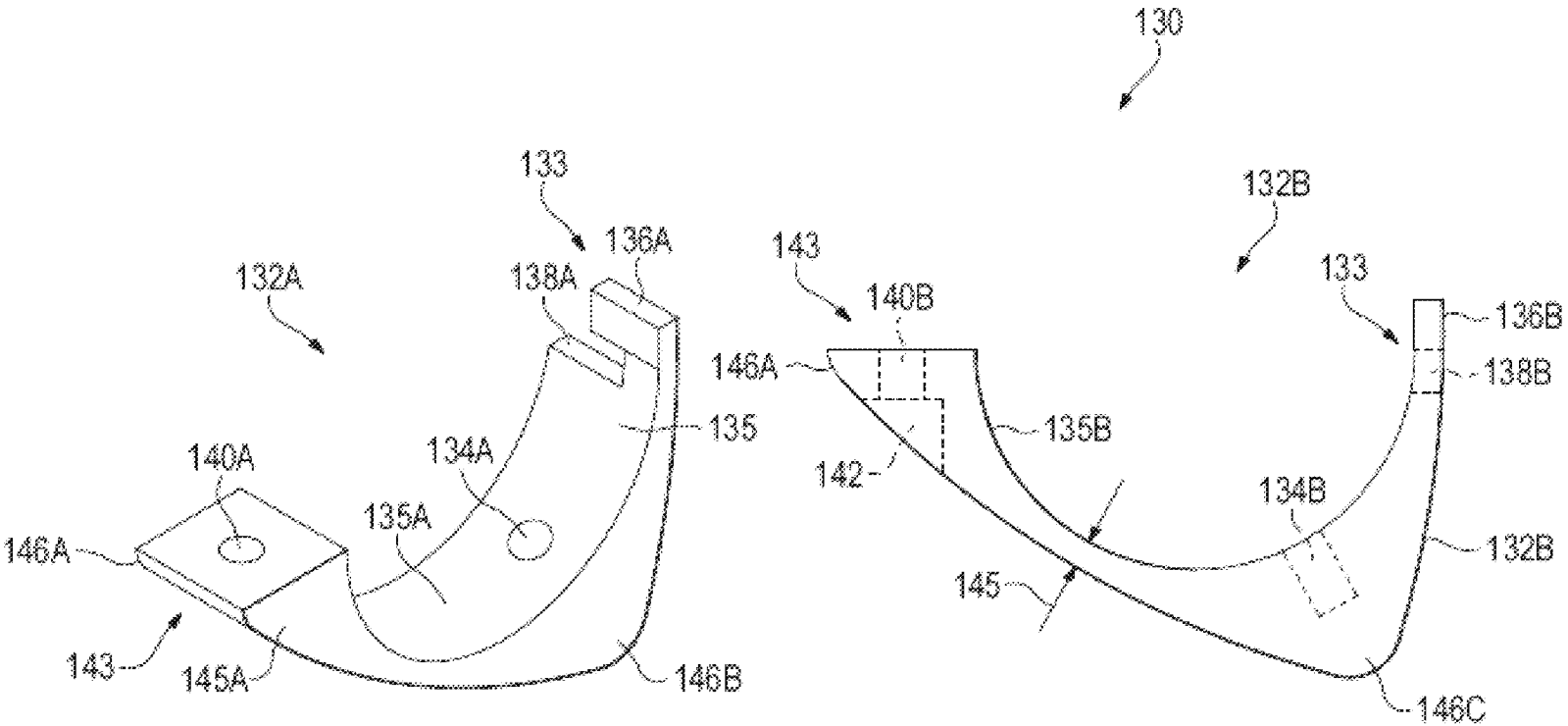
FIG. 5 illustrates the example spacer discs of FIG. 4 in more detail.

FIGS. 3-5 illustrate in more detail how the spacer discs 130 may be separately interlocked together and attached to the shaft 182. In some examples, the shaft 182 may be made from a round elongated steel pipe. However, other triangular or square shapes shafts can also be used. The shaft 182 may be connected to the opposite walls of the screen frame 103 (FIG. 1) via guides 188, end plates 190 and cap plates 192.

Holes 186 (FIG. 3) may be drilled through one side of the shaft 182 along substantially the entire shaft length. The holes 186 are positioned at the desired lateral positions on shaft 182 for locating the spacer discs 130. Key pins or spring pins 184 insert and compressibly attach into holes 186. Alternatively, dowel pins can be force fit or welded into the holes 186 or pins can be welded onto the outside surface of shaft 182.

Referring to FIG. 5, the spacer disc 130 may comprise two sections 132A and 132B that are the exact same shape and therefore can both be made from the same mold. One of the sections 132A or 132B may be turned upside down and attaches and interlocks with a corresponding end of the other section 132. The two sections 132A and 132B when attached together around shaft 182 form a symmetrical half of a triangular profile perimeter with three arched sides and three lobes 146A, 146B, and 146C.

The two sections 132A and 132B each have an inside wall 135A and 135B, respectively, that are each sized and shaped to snugly press against and around half of the outside circumference of the shaft 182. Where the shaft 182 has a circular outside cross-sectional shape, the inside walls 135A and 135B each form a semi-circular shape that extends around half of the outside surface of the shaft 182.

The two sections 132A and 132B may each include an interlocking end 133 and a coupling end 143. The interlocking ends 133 include notches 138A and 138B that extend perpendicular into a first side of the sections 132A and 132B, respectively. Locking members 136A and 136B may extend perpendicularly from a second side of the sections 132A and 132B above the notches 138A and 138B, respectively.

Additionally, one or both of sections 132A and/or 132B may have a hole 134A and/or 134B formed in the inside wall 135A and/or 135B, respectively. The hole 134A and/or 134B may be sized to slidingly receive one of the pins 184 that extend out of the shaft 182 as shown in FIG. 3. One of the two sections 132A or 132B is attached to the shaft 182 such that the pin 184 slidingly inserts into hole 134A or 134B. The pin 184 may be configured to prevent any rotational movement of the spacer disc 130 against the shaft 182 during operation as well as guaranteeing the location of the spacer disc 130 during maintenance replacement.

The section 132A or 132B that is not attached to pin 184 may be rigidly interlocked with the other section 132 currently attached to shaft 182. In some examples, section 132B has already been attached to the shaft 182, one of the pins 184 inserts into hole 134B, and the inside wall 135B presses and extends against half of the outside circumference of the shaft 182.

Section 134A is flipped around 180 degrees from the position shown in FIG. 5. The section 132A is then pressed against the opposite half of the outside circumference of the shaft 182 but in a lateral position on shaft 182 adjacent to spacer section 134B. Spacer section 134A is then slid over the same lateral portion of shaft 182 where section 134B is located. While sliding over section 134B, the locking member 136A in section 132A 134A inserts into the notch 138 B formed in spacer section 132B. At the same time the locking member 136B in spacer section 132B slides into notch 138A formed in spacer section 132A. This interlocks the two sections 132A and 132B together at the interlocking end 133.

Figure 6A:
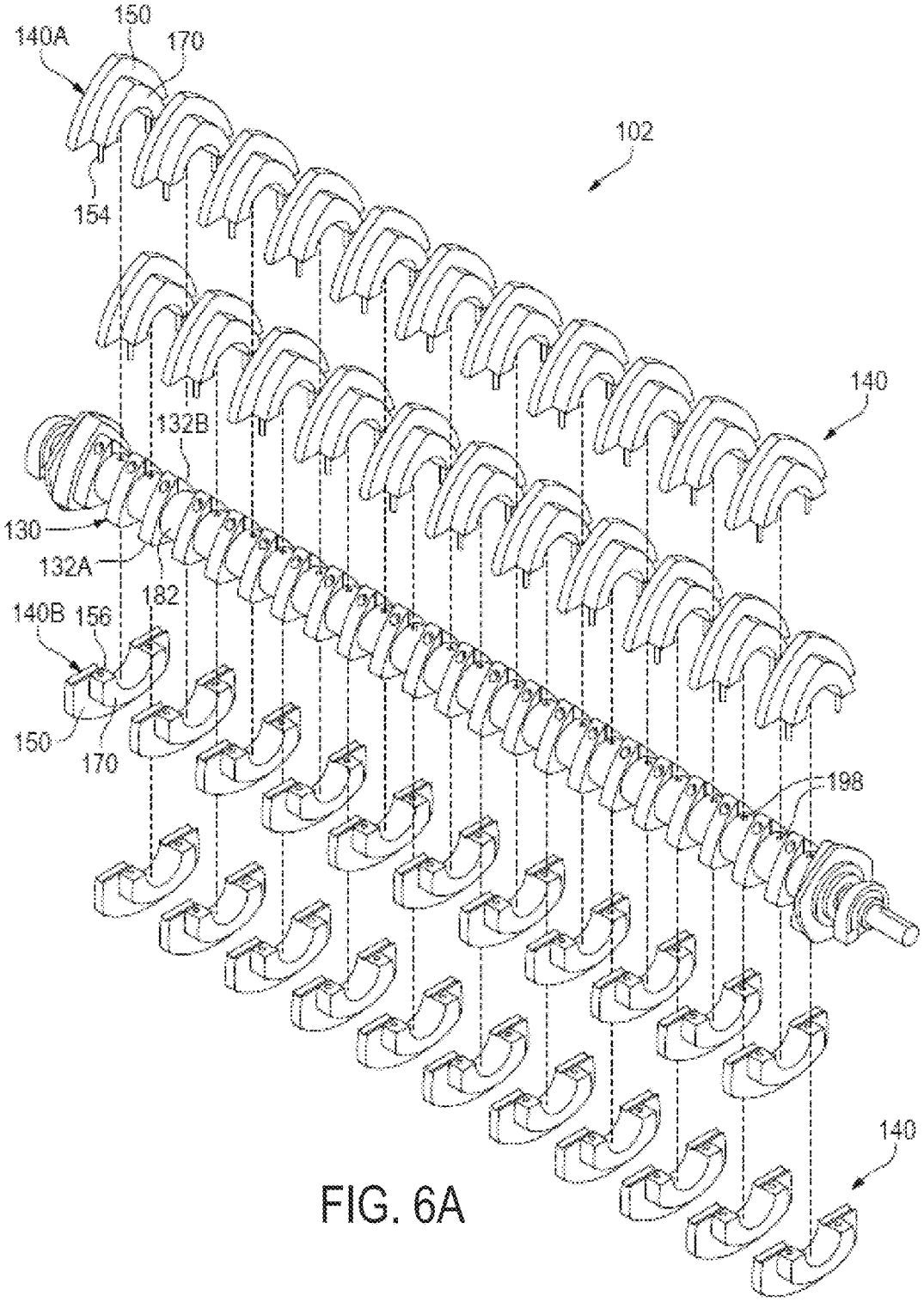
FIG. 6A illustrates the example spacer discs of FIG. 4 attached to the shaft and compound discs shown in an exploded view.

When the two sections 134A and 134B are interlocked together, the coupling ends 143 of spacer sections 132A and 132B are positioned against each other face to face. Holes 140A and 140B are aligned with each other and form one continuously hole through lobe 146A. A bolt (not shown) is inserted into one of the cavities 142 formed in one of the spacer sections 132A or 132B, and through the two holes 140A and 140B. A threaded nut (not shown) is inserted into a similar shaped cavity 142 formed in the opposite section 132A or 132B and screwed onto the end of the bolt locking the two spacer sections 132A and 132B together as shown in FIG. 6A below.

The length of the shaft 182 and alignment of the multi-diameter disc assembly 110 may include single end discs 152 attached on the lateral ends of shafts 182. The end discs 152 may have the same shape as a single intermediate disc 170 or a single large diameter disc 150. The end discs 152 may have two different sections 152A and 152B that attach together around the shaft 182 in a manner similar to the compound discs 140 as described in more detail below in FIGS. 6A and 7A-7C. Further example interlocking disc assemblies are described in U.S. Pat. No. 8,424,684 entitled Multi-Diameter Disc Assembly for Material Processing Screen, the contents of which are herein incorporated by reference in their entirety.

As explained above, in some examples the smaller diameter spacer discs 130 do not transport much of materials 206 up the disc screen 102 (FIG. 1). Therefore, the spacer discs 130 may be made out of a harder less gripping material than the compound discs 140. For example, the spacer discs 130 may be made from a relatively hard fiberglass, polymer, nylon, or metal material, while the compound discs 140 may be made out of a substantially softer rubber material. In some examples, the spacer discs 130 may be made from a polyphthalamide (aka. PPA, High Performance Polyamide) which is a thermoplastic synthetic resin of the polyamide (nylon) family. In still other examples, the spacer discs 130 may be made from polyurethane.

The spacer discs 130 can not only be made from a harder material than the rubber compound discs 140 but can also be separately attached to the shaft 182. Thus, the compound discs 140 can be replaced without also having the replace the spacer discs 130. In other tri-disc designs, all three discs may be formed from the same piece of rubber material. Thus, whenever the large and/or intermediate discs wear out, smaller discs may also be replaced.

Using a harder material for the smallest diameter spacer discs 130 may allow for the use of larger diameters shafts 182 that reduce the overall amount of material needed for the multi-diameter disc assembly 110. Referring to FIG. 5, the spacer discs 130 have the smallest outside diameter of the three discs 130, 150 and 170. Therefore, the spacer discs 130 may be configured with the smallest material thickness between the outside surface of the shaft 182 and the smallest outside perimeter of the spacer disc 130 at locations 145.

A minimum material thickness is provided at locations 145 to keep the spacer disc 130 from tearing apart. Using materials that are harder and more wear resistant than rubber allow the spacer discs 130 at locations 145 to be thinner. This allows the use of larger diameter shafts 182, resulting in larger center holes 172 (FIG. 7C) in the multi-diameter disc assemblies 110, and the use of less material in the multi-diameter disc assemblies 110. Thus, the costs of manufacturing and shipping the multi-diameter discs 110 may be reduced.

FIG. 6A illustrates an isolated view of one row of the example disc screen 102 of FIG. 1 with the spacer discs 130 attached to the shaft 182 and the compound discs 140 shown in an exploded view. In some examples, the example disc screen 102 illustrated in FIG. 6A may be configured as a polishing screen.

Figure 6B:
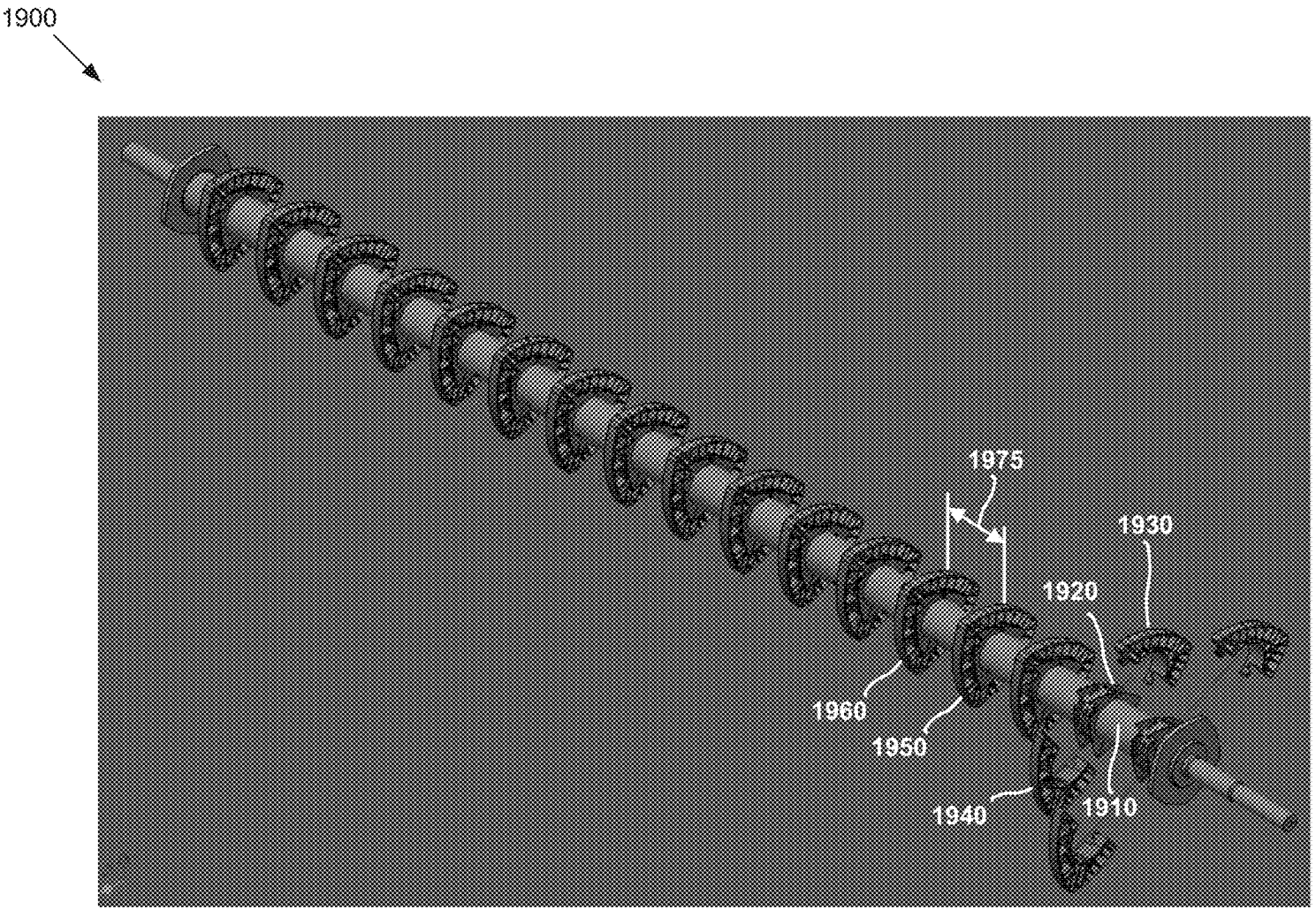
FIG. 6B illustrates a partially exploded view of an example apparatus configured for sorting paper products such as newspaper.

FIG. 6B illustrates a partially exploded view of an example sorting apparatus 1900 configured for sorting paper products such as newspaper. The sorting apparatus 1900 may comprise a partially exposed shaft 1910 with a plurality of hubs 1920 for attaching one or more sorting discs, such as disc 1950. In some examples, the hubs 1920 may be welded or bolted to the shaft 1910, such that some or all of the discs may be removed from the shaft 1910 without removing the hubs 1920.

One or more of the discs may comprise a first disc portion 1930 and a second disc portion 1940 which may removably attached to the shaft 1910. The first disc portion 1930 may be configured to mount to an opposite side of the shaft 1910 as the second disc portion 1940. Additionally, the first disc portion 1930 may be configured to mount to the second disc portion 1940, such as with an interlocking attachment, one or more bolts, or other attachment means.

In order to separate larger fiber materials, sorting apparatus 900 may be configured as part of a screen, comprising a plurality of shafts, having openings that allow smaller fiber and containers to pass through the screen. An IFO may be formed between two discs, such as a first disc 1950 and a second disc 1960, such that the distance 1975 between discs may determine a length of the IFO. Additionally, the shaft surfaces of two parallel spaced apart shafts may further bound a width of the IFO. By creating the IFO along the shaft 1920 and between discs 1950, 1960, the IFO may be formed with a constant length 1975, and also a constant width between shafts, to accurately sort material according to its size, while selectively transporting fiber material, such as newspaper, up the screen.

Additionally, some or all of the discs may be coated with a wear material to further facilitate sorting and/or transport of select materials up the screen. Different types of material may be sorted by varying the spacing of the discs, the number of the discs, the diameter of the discs, the outer profile of the discs, the type of wear material used to coat the discs, an inclination angle of the screen, or any combination thereof.

Figure 7A:
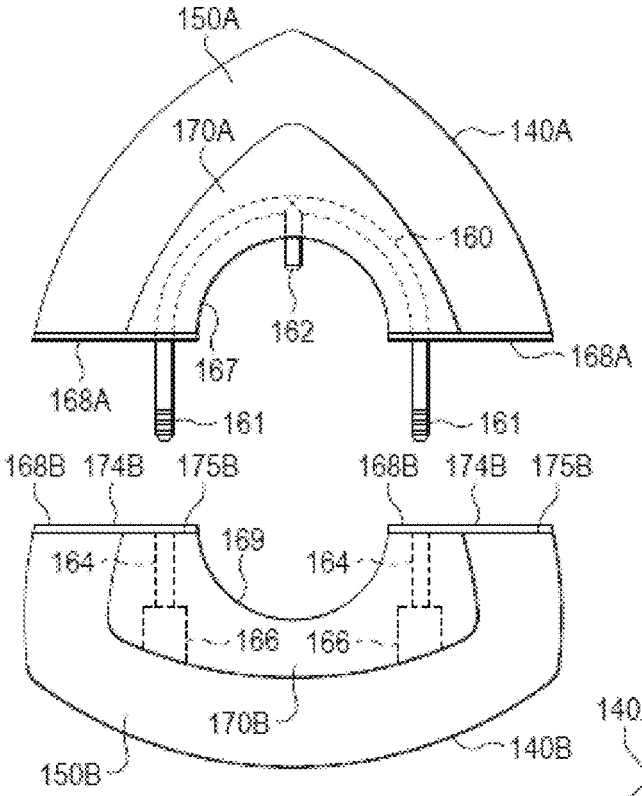
FIGS. 7A-7C illustrate example compound discs.
Figure 7B:
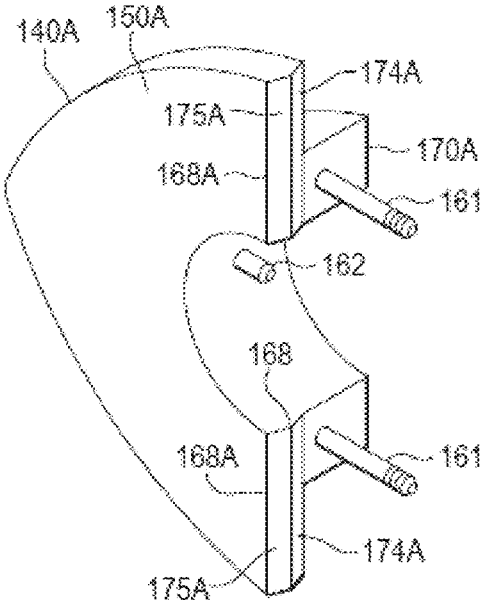
Figure 7C:
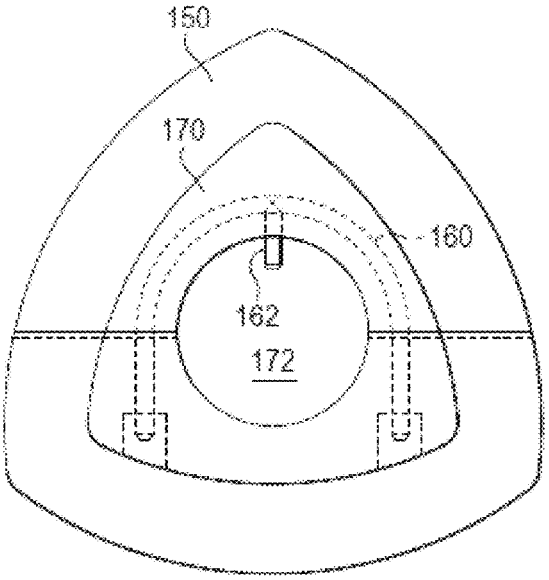

FIGS. 7A-7C illustrate examples of the compound discs 140 in more detail. As described above, the compound discs 140 may be formed from a separate piece of material than the spacer discs 130. Forming the spacer discs 130 and compound discs 140 out of separate pieces of material may allow the compound discs 140 to be separately replaced while the spacer discs 130 remain attached to the shafts 182.

Each of the separate discs can have any variety of different shapes, sizes, and number of sides. Discs with different combinations of shapes, sizes, and number of sides can also be combined together. For example, a three sided triangular disc may be combined with a four sided square shaped disc in the same compound disc.

The compound discs 140 may be configured to include an upper section 140A and a lower section 140B that connect together around the shaft 182. The lower compound disc section 140B includes a lower large disc portion 150B that that may be integrally formed with a lower intermediate disc portion 170B from a same piece of material. Holes 164 extend through opposite ends of the lower intermediate disc portion 170B. An inside wall 169 of the lower compound disc section 140B has a semi-circular shape that snugly presses around half of the outside circumference of the shaft 182.

The upper compound disc section 140A includes a large disc portion 150A and intermediate disc portion 170A that may both be integrally formed together from the same piece of material. A U-bolt 160 may be molded into the intermediate disc portion 170A with opposite ends 161 that extend out from opposite ends 168A of the compound disc section 140A. A locating pin 162 is located at the center of the U-bolt 160 and extends out from an internal wall 167. The inside wall 167 of the upper compound disc section 140A also has a semi-circular shape that snugly attached around a second half of the circumference of the shaft 182.

The locating pin 162 is inserted into one of the holes 198 in shaft 182 shown in FIG. 4 and prevents the compound disc 140 from sliding against the shaft 182. The inside surface 167 is pressed down against the upper half of the shaft 182 so that the opposite ends 161 of the U-bolt 160 extend on opposite sides of the shaft 182.

The lower compound disc section 140B is pressed underneath a bottom end of the shaft 182 so that the ends 161 of U-bolt 160 insert into holes 164. The inside surface 169 of lower section 140B is pressed against the lower outside surface of the shaft 182 while the opposite ends 168A and 168B of the upper and lower compound disc sections 140A and 140B, respectively press against each other.

The opposite ends 168A of the upper section 140A have a flat surface 174A (FIG. 7B) and an inclined surface 175A. The opposite ends 168B of the lower section 140B also have a flat surface 174B and an upwardly inclined surface 175B oppositely opposed with surfaces 174A and 175A, respectively. The surfaces 174A and 174BA and surfaces 175A and 175B press against each other when the two sections 140A and 140B are pressed against the shaft 182.

When the two sections 140A and 140B are fully attached together, the ends 161 of U-bolt 160 extend through holes 164 and into the openings 166 formed in intermediate disc portion 170B. Nuts (not shown) are inserted into openings 166 and screwed onto the ends 161 of U-bolt 160 holding the two sections 140A and 140B of the compound disc 140) tightly together and tightly against the shaft 182. The compound discs 140 when fully assembled as shown in FIG. 7C having a triangular profile with three arched sides and a circular center hole 172.

Figure 8A:
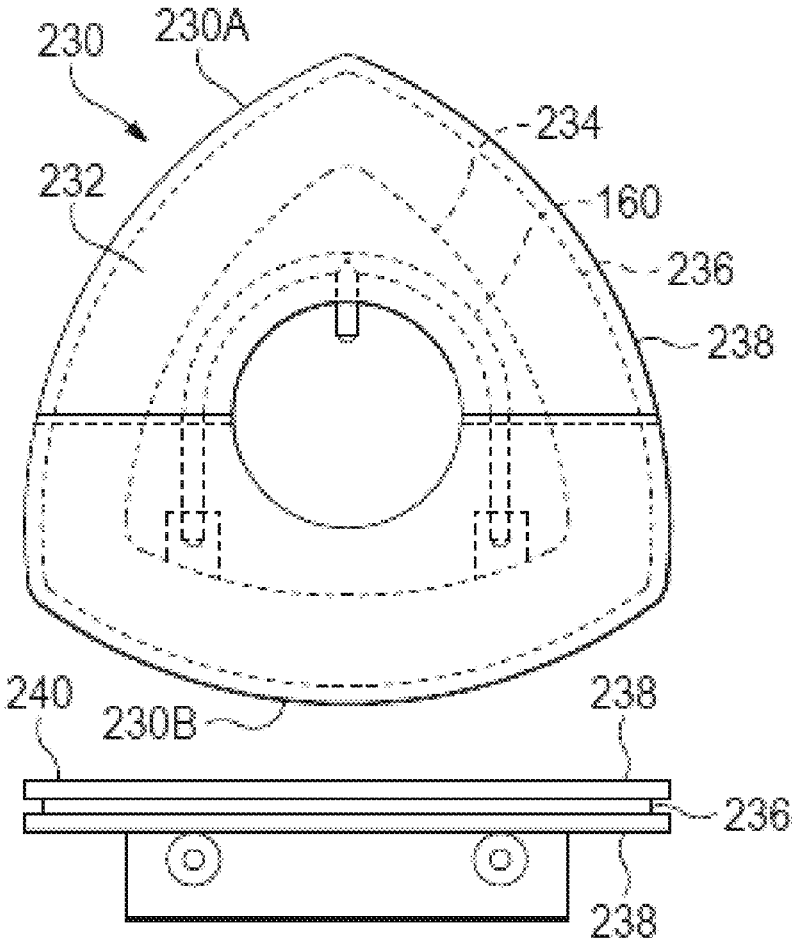
FIG. 8A illustrates an example disc assembly comprising a channel.

FIG. 8A illustrates an example compound disc 230, including a side view and front view, similar to the compound disc 140 described above that includes an intermediate disc 234, a large disc 232, and upper and lower compound disc sections 230A and 230B that attach around the shaft 182 of the disc screen 102 shown in FIG. 1. A channel 236 is formed into an outside perimeter surface of the large diameter disc 232. The channel 236 effectively forms a tread of two parallel ribs 238 that extend above and around opposite sides of the entire outside perimeter of the large diameter disc 232. This tread design can more effectively grip and transport certain types of material up disc screen 102 (FIG. 1) for more efficient material separation.

Figure 8B:
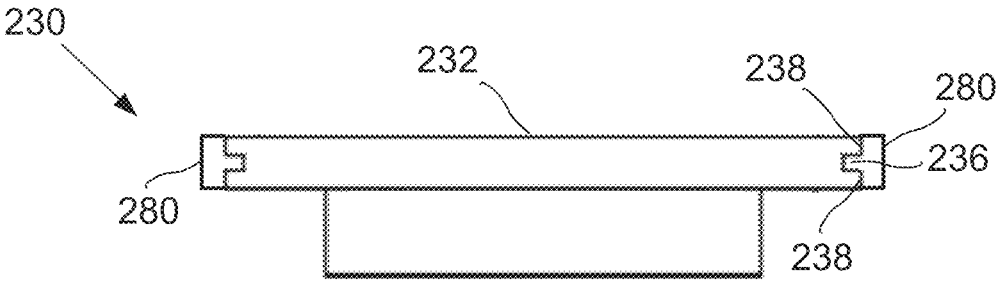
FIG. 8B illustrates cross-sectional view of the example disc assembly of FIG. 8A, including a wear material.

FIG. 8B illustrates a cross-sectional view of the example compound disc 230 of FIG. 8A with a wear material 280 provided around the perimeter of the disc 232. Wear material 280 may be formed at the exterior contact surface, or transport surface, of the disc 232. In some examples, wear material 280 may be formed, molded, sprayed on, or otherwise deposited into channel 236 and onto ribs 238. Channel 236 may provide additional surface area to which wear material 280 may adhere and therefore be configured to resist separation of the wear material 280 from the disc 232 during operation.

Disc assembly 230 may comprise a substantially rigid disc core 232 including a first section 230A removably attached to a second section 230B and configured to be mounted to a disc screen shaft. The disc core 232 may comprise a textured transport surface extending between a left side of the disc core 232 and a right side of the disc core 232. Wear material 280 may comprise a replaceable coating of substantially non-rigid wear material that is deposited along an outer perimeter of the disc core 232 and penetrates into the textured transport surface.

The textured transport surface may comprise a grooved recess, such as channel 236, located in the outer perimeter of the disc core 232, and at least a portion of the wear material may be deposited into the grooved recess along the outer perimeter of the disc core 232. Additionally, the wear material may be deposited on the two parallel ribs 238 of the textured transport surface.

In some examples, the replaceable coating may be bounded by the textured transport surface without the wear material 238 being deposited on the left side and the right side of the disc core 232. In other examples, at least a portion of the wear material may be additionally deposited on the left side and the right side of the disc core 232.

Wear material 280 may radially extend from the channel 236 and/or exterior surface of the ribs 236 and increase the effective diameter of the disc 32. The diameter of the disc 232 may vary according to the amount or thickness of wear material 280 that is attached to the channel 236 and/or ribs 238. In some examples, the thickness of wear material 280 that extends outside of the ribs 238 may be approximately 0.125 inches.

Figure 9:
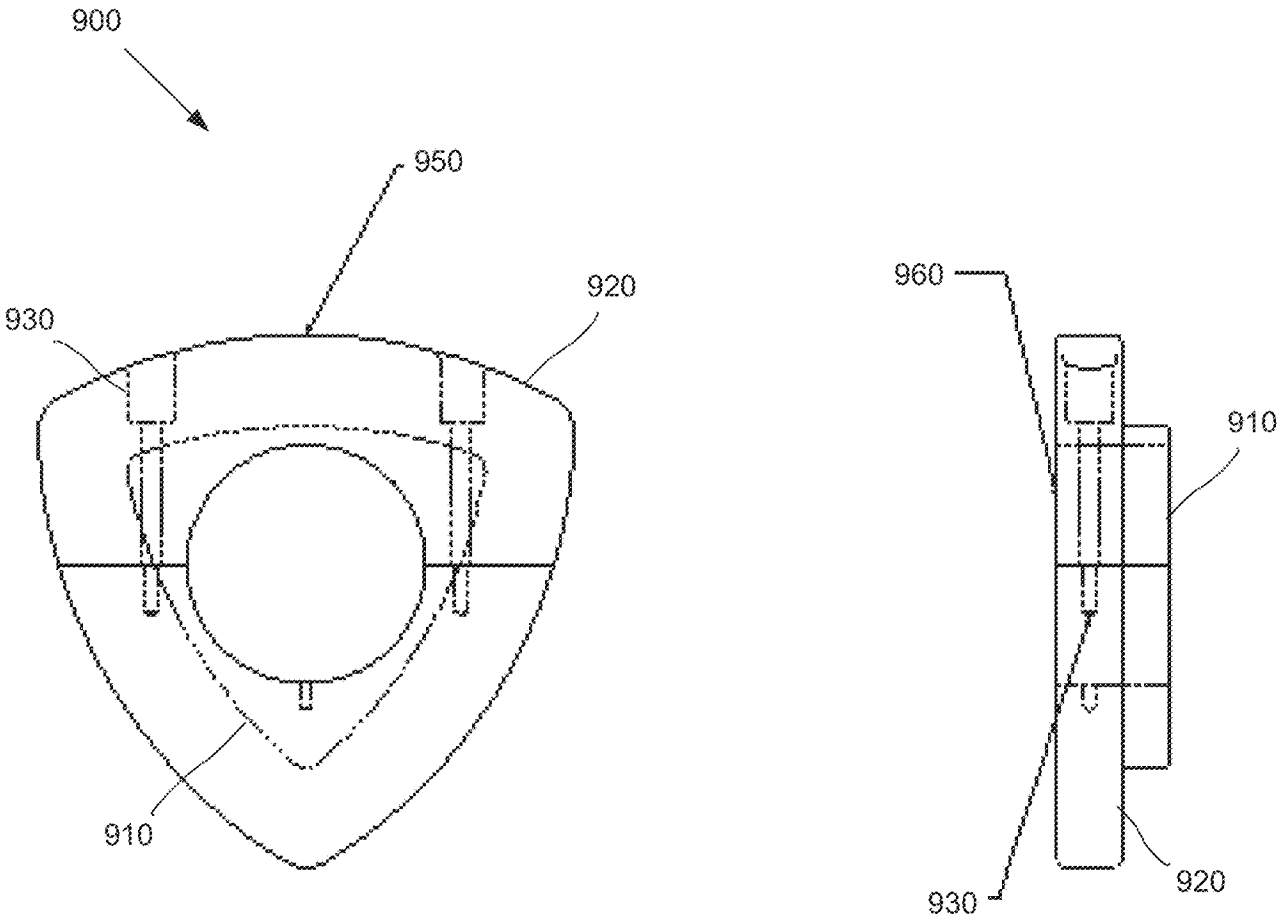
FIG. 9 illustrates an example disc assembly in which substantially the entire outer surface may be coated with a wear material.

FIG. 9 illustrates an example disc assembly 900 including as a front view and a side view, in which substantially the entire outer surface may be coated with a wear material. For example, the disc assembly 900 may comprise a substantially rigid structure which may be dipped into, sprayed, or otherwise coated with, wear material, such that not only a transport surface 950 but also side surfaces 960 of the disc assembly 900 may be coated with wear material.

Disc assembly 900 may comprise one or more discs, such as a small disc 910 and a large disc 920, which may be attached to shaft. In some examples, disc assembly 900 may comprise a clamping device 930 which may be being used to attach the discs 910, 920 to the shaft. The discs 910, 920 may also be attached using fasteners or weldments, for example.

Small disc 910 and large disc 920 may be manufactured and/or attached to the shaft as an integral assembly. In other examples, small disc 910 and large disc 920 may be separately manufactured and/or attached to the shaft. Disc assembly 900 may comprise a two-part assembly which attach about either side of the shaft. In other examples, disc assembly 900 may comprise a multitude of parts that assemble together.

Figure 10:
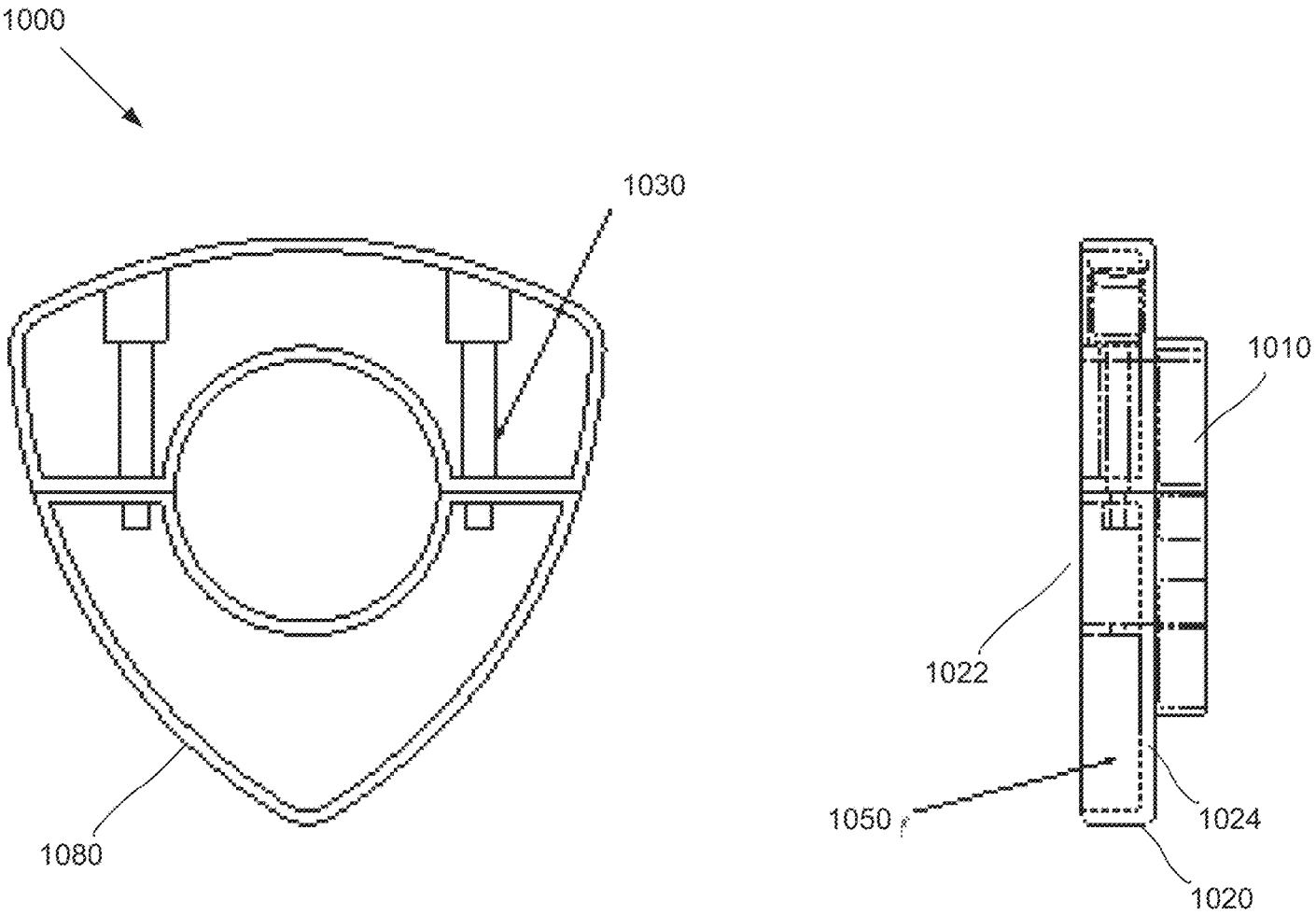
FIG. 10 illustrates an example disc assembly in which need only the outer material transport surface may be coated with a wear material.

FIG. 10 illustrates an example disc assembly 1000, including as a front view and a side view, in which only the outer material transport surface 1050 may be coated with a wear material 1080. Selectively applying wear material to transport surface 1050 may reduce the amount of raw material used to create the assembly 1000 and similarly reduce the overall cost and weight.

Similar to the disc assembly 900 illustrated in FIG. 9, disc assembly 1000 may comprise a small disc 1010, a large disc 1020, and a clamping device 1030; however, other examples may include fasteners, weldments, and discs comprising individual, two-part, or a multitude of parts, assemble and/or arranged in any number of ways.

A first disc, such as small disc 1010 may comprise a first transport surface located along an outer perimeter of the first disc 1010. First disc 1010 may be associated with a first diameter. Similarly, a second disc such as larger disc 1020 may be associated with a second diameter. The second diameter may be larger than the first diameter.

Second disc 1020 may include a textured transport surface 1050 extending between a left side 1022 of the second disc 1020 and a right side 1024 of the second disc 1020. A replaceable coating of substantially non-rigid wear material 1080 may be deposited along an outer perimeter of the second disc 020 and penetrates into the textured transport surface 1050.

In some examples, second disc 1020 may be separately attachable to a shaft from the first disc 1010. The first disc 1010 may abut up against a side of the second disc 1020, such as right side 1024, after the disc assembly 1000 is attached to the shaft. Additionally, a replaceable coating of wear material 1080 may be bounded by the textured transport surface 1050 without the wear material being deposited on the side(s) of the second disc 1020. In some examples, the wear material 1080 may be deposited on both the first disc 1010 and the second disc 1020 after the disc assembly 1000 is attached to the shaft, and may be deposited on one or more sides of second disc 1020.

One or more of the discs and/or disc assemblies described herein may be manufactured or otherwise configured to include a wear material having different material characteristics than the underlying rigid disc structure. The wear material may have a different adhesive characteristic, for example to provide a better grip or increased friction force on the material being sorted. In some examples, the wear material may provide for a softer contact surface, such as when handling relatively fragile materials. Additionally, the wear material may be lighter than the material of the underlying disc, and decrease the overall weight of the disc assembly.

Different types of wear material may be used to provide different material sorting characteristics. For example, some type of wear material may provide for increased friction and/or durability in hot or cold temperatures, in dry or humid conditions, in air that is dusty or includes particulates, other types of operating environments, or any combination thereof. Additionally, as the system may be configured to sort a wide range of materials which may interact or behave differently in the operating environment, the wear material for the discs may be selectively applied to provide a particular function or exhibit a particular behavior in a customized manner.

In some examples, the discs may be removed and installed as individual discs or disc assemblies. The new discs max comprise a different wear material than the discs which were removed. Discs having different wear materials may be combined in the same material sorting system, whether on the same separation screen or on two or more separation screens which may be sequentially linked to each other in the material stream.

The material separation screen may comprise both primary and secondary discs. In some examples, the primary discs may be relatively larger than the secondary disc. Additionally, the wear material may be preferentially applied to one or both of the primary and secondary discs according to the material separation system specifications. In some examples a relatively softer wear material may be applied to the primary or large discs. The wear material may be replaced and/or recoated on to the primary discs as needed. Accordingly, the primary discs may be refurbished at much lower cost as compared to manufacturing new discs.

As discussed above, the disc and shafts may be considered wear items that may be replaced or refurbished at certain intervals depending on the material characterization being processed. Providing a disc with a replaceable wear surface may substantially eliminate the costly replacement and disposal of disc materials by creating a re-useable underlying rigid disc structure or core that may be remanufactured and/or refurbished with a new wear surface and then used over and over again in a separation screen.

In some examples, the wear material may comprise a single part or a two part coating of urethane and/or polyuria. The coating(s) may be applied to the disc core by pouring, spraying or over-casting. The wear material may have a high tear and tensile strength while also maintaining a high coefficient of friction. The wear material's physical attributes may also be modified through chemistry and/or heat treatment to alter the properties for use in different markets, such as cold weather, compost, fuel, concrete, mining, wood products, MSW, and Construction and Demolition (C&D).

Figure 11:
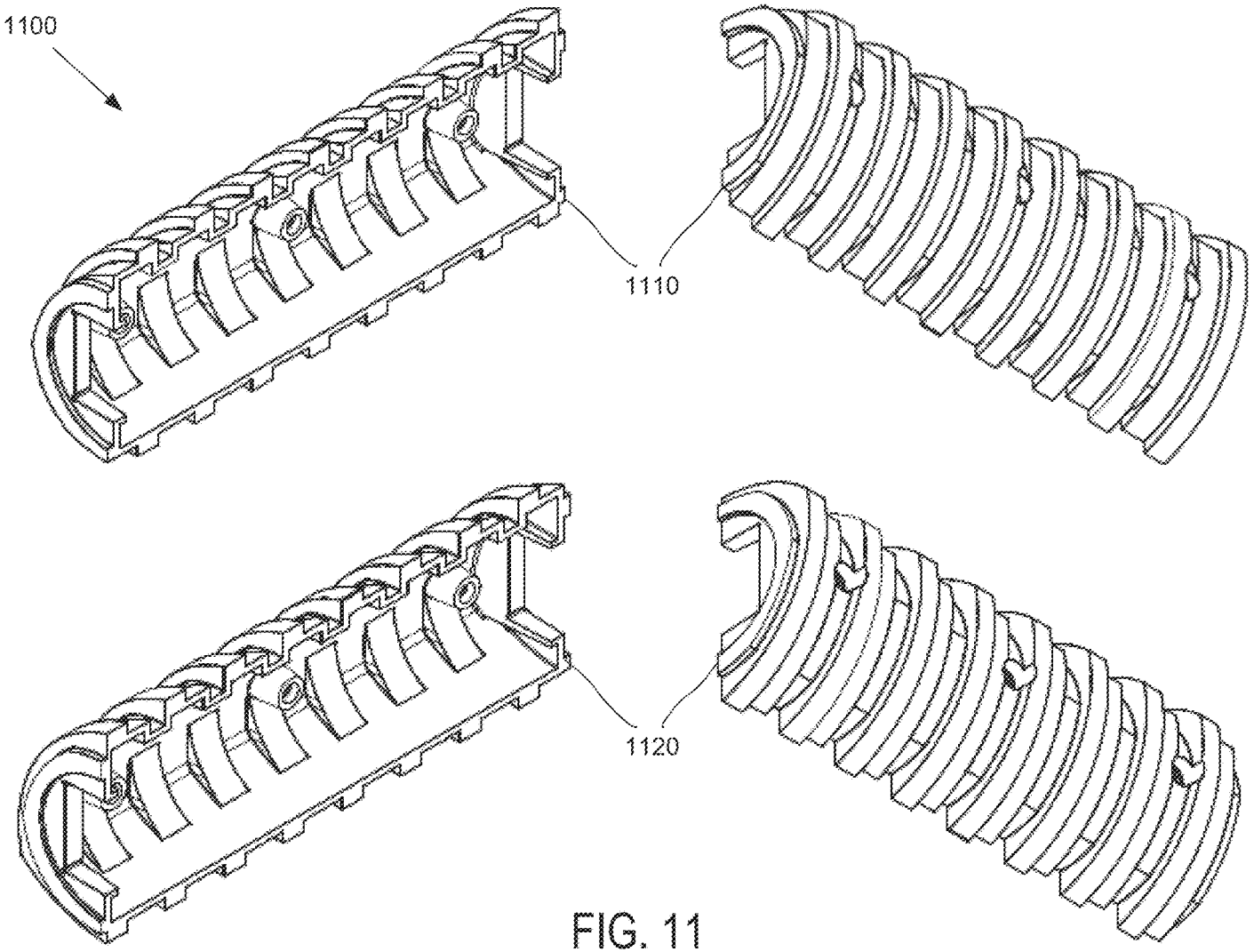
FIG. 11 illustrates an example multi-disc and shaft assembly that may be coated with a wear material.

FIG. 11 illustrates an example composite disc and shaft assembly 1100, comprising a first portion 1110 of the multidisc assembly 1100 detached from a second portion 1120 of the multidisc assembly 1100, which may be coated with a wear material. Both the interior and exterior of the first and second portions 1110, 1120 are shown for purposes of illustration. In some examples, substantially the entire outer surface of the assembly 1100 may be coated with a wear material.

The assembly 1100 may comprise a plurality of discs and/or spacers manufactured as an integral assembly that may be attached to a shaft of a separation screen. Assembly 1100 may comprise two halves 1110, 1120 configured to be clamped, secured, or otherwise attached about either side of the shaft. In some examples, a number of such assemblies may be attached or bolted directly to the shaft to create a larger final assembled component that is used in the screening system.

A multi-disc shaft assembly, such as the example composite disc and shaft assembly 1100, may be configured to allow for changes in the geometry that provide a different sized IFO for use with different shafts. For example, the composite disc and shaft assembly 1100 may be configured to allow fine material to pass through the screen. Additionally, the individual disc shapes and/or outer profiles may be modified to allow a range of materials of varying size or dimensions, such as between two and twelve inches, to pass through the screen. Once the wear material has been worn through or otherwise reached an end of useful life, the composite disc and shaft assembly 1100 may be removed and recoated.

Figure 12:
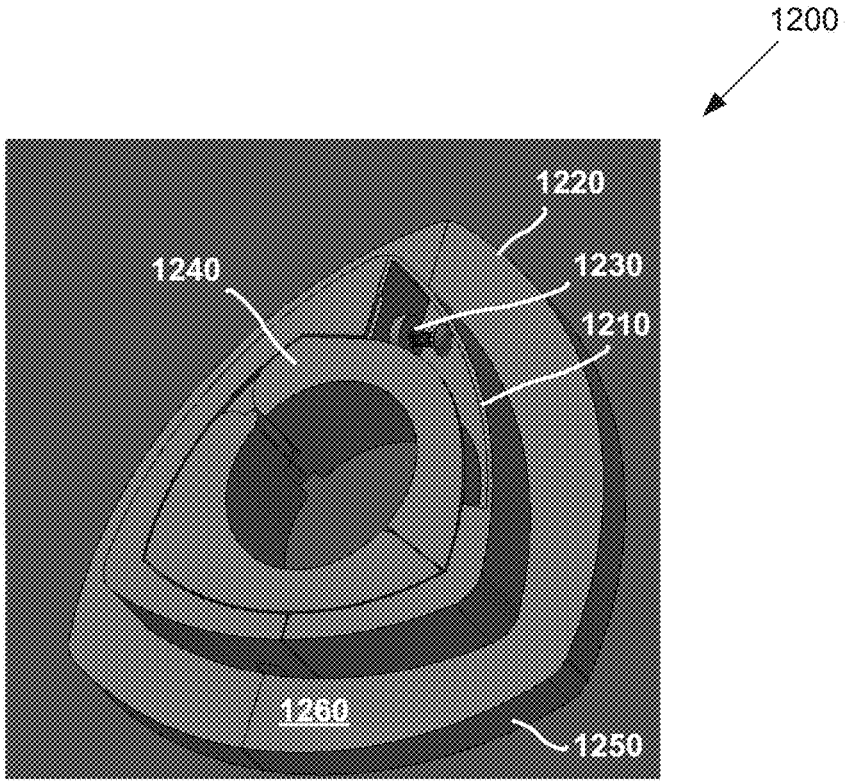
FIG. 12 illustrates an example disc assembly comprising a dis-shaped hub.

FIG. 12 illustrates an example disc assembly 1200 comprising a disc-shaped hub 1240. Hub 1240 may be manufactured out of steel and expected to have a long lifespan and, in some examples, may comprise a semi-permanent bolt in core. Disc assembly 1200 may additionally comprise one or more discs, such as a small disc 1210 and a large disc 1220, which may be attached to hub 1240. In some examples, disc assembly 1200 may comprise a clamping device 1230 which may be being used to attach the disc assembly 1200 to a shaft.

Small disc 1210 and large disc 1220 may be manufactured and/or attached to the hub 1240 as an integral assembly. In other examples, small disc 1210 and large disc 1220 may be separately manufactured and/or attached to hub 1240. Disc assembly 1200 may comprise a two-part assembly which attach about either side of the shaft. In other examples, disc assembly 1200 may comprise a multitude of parts that assemble together.

The disc shape of hub 1240 may comprise a generally triangle, pentagon, or star shaped profile, for example, where the distance of the exterior surface of the hub 1240 from the interior cylindrical surface may vary along the circumference. Varying the wall thicknesses of the hub 1240 may be operable to transmit additional energy from the shaft into the disc assembly 1200.

In some examples, one or both of the large disc 1220 and the small disc 1210 may be manufactured out of a wear material which may be substantially softer than the material used for the core 1240. In other examples, an outer material transport surface 1250 of the disc assembly 1220 may be coated with a wear material. Additionally, the outer transport surface 1250 may comprise the outer perimeter of the large disc 1220 and/or the outer perimeter of the small disc 1210. In still other examples, the transport surface 1250 and one or more sides 1260 of the disc(s) may be coated with wear material.

Figure 13:
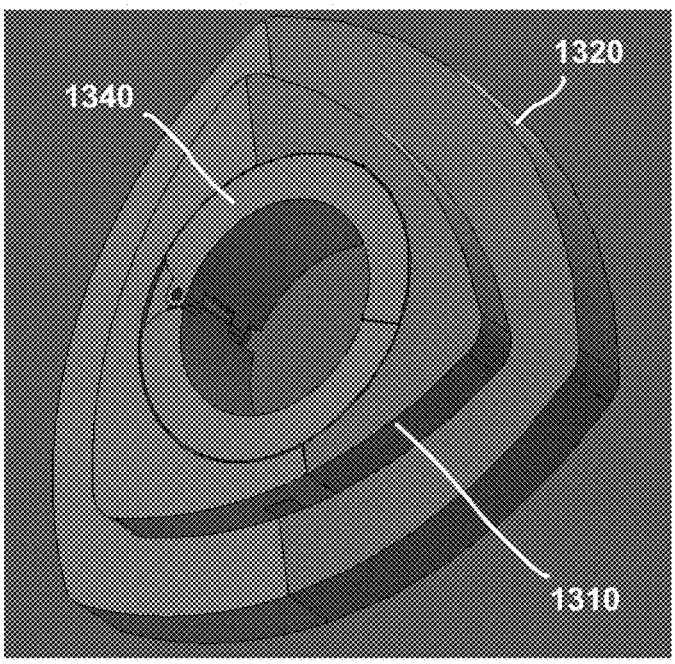
FIG. 13 illustrates an example disc assembly comprising a round-shaped hub.

FIG. 13 illustrates an example disc assembly 1300 comprising a round-shaped hub 1340. Other than the round-shaped hub 1340, disc assembly 1300 may be configured similarly as disc assembly 1200 of FIG. 2, including a small disc 1310 and a large disc 1320 attached to hub 1340.

Figure 14:
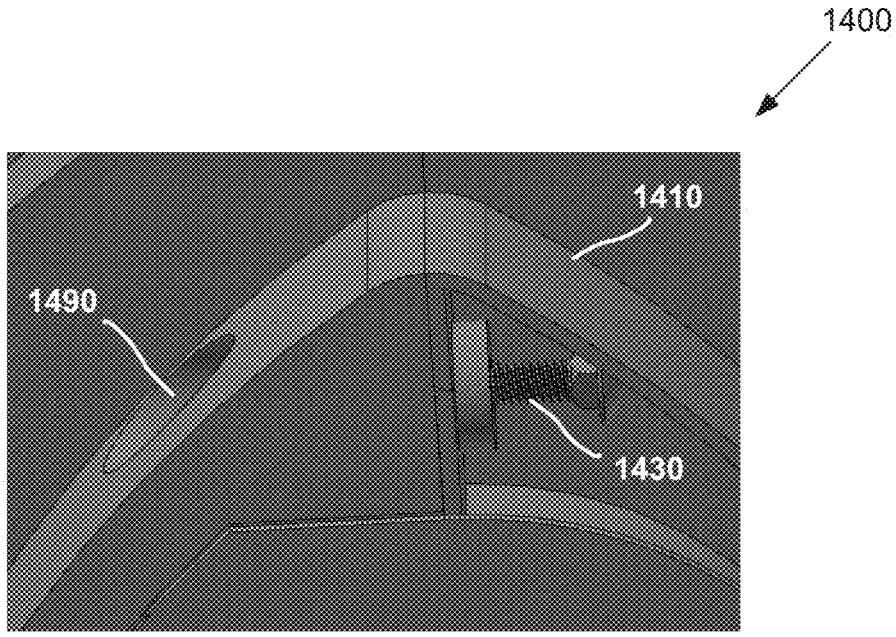
FIG. 14 illustrates an enlarged partial view of a disc assembly that includes an attachment design comprising a through hole.

FIG. 14 illustrates an enlarged partial view of a disc assembly 1400 that includes an attachment system 1430 comprising a through-hole 1490. In some examples, attachment system 1430 may be configured similarly as clamping device 1230 of FIG. 2, in which through-hole 1490 may pass through at least a portion of a small disc 1410 of disc assembly 1400.

Figure 15:
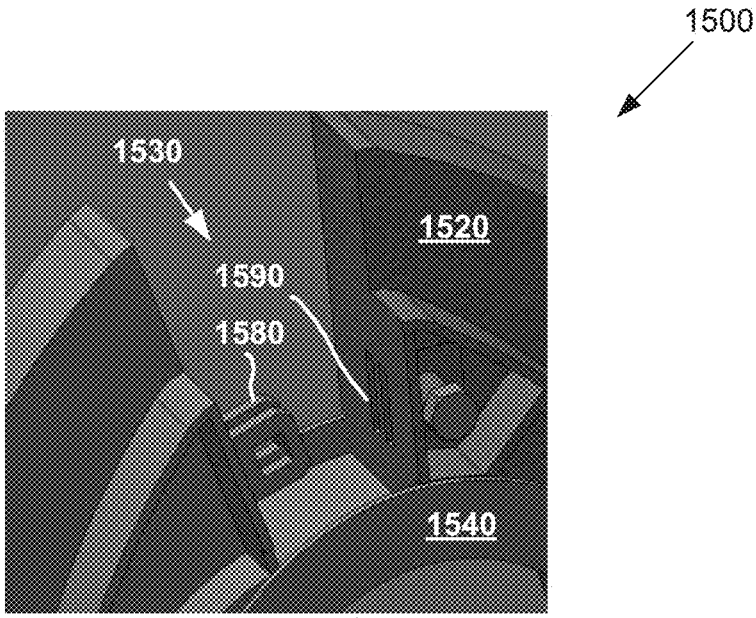
FIG. 15 illustrates an enlarged partial view of a disc assembly that includes an attachment design comprising an overlapping tab.

FIG. 15 illustrates an enlarged partial view of a partially disassembled disc assembly 1500 that includes an attachment system 1530 comprising one or more tabs 1580. Tabs 1580 may be used to attach two or more portions of disc assembly 1500 to each other. In some examples, tabs 1580 may be configured as an overlapping tab arrangement comprising two spaced apart tabs. Tabs 1580 may be configured to be inserted into complimentary receiving slots 1590 of attachment system 1530. Attachment system 1530 may be configured to attach one or more discs 1520 of disc assembly 1500 about or to a rigid hub 1540.

Figure 16:
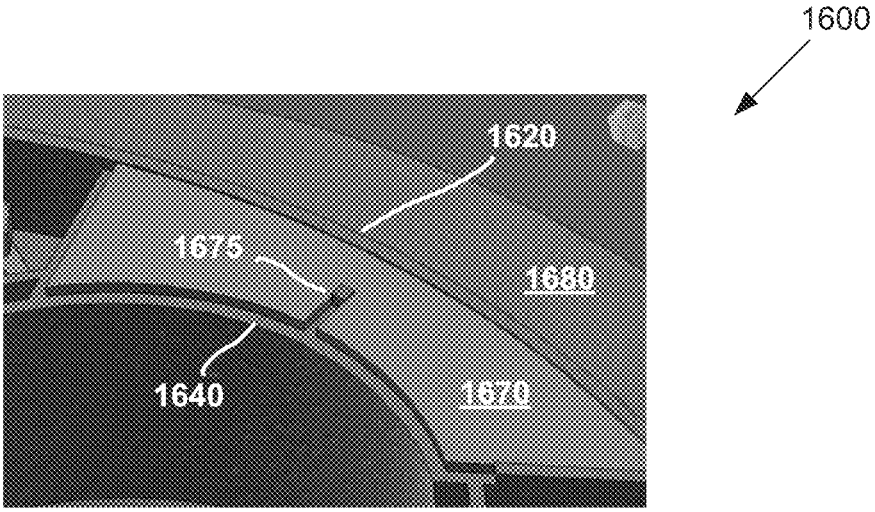
FIG. 16 illustrates an enlarged partial view of a disc assembly that includes a side plate.

FIG. 16 illustrates an enlarged partial view of a disc assembly 1600 comprising a side plate 1670. Certain types of coating applications may be physically affected by sharp edges and cavities, which may decrease the life expectancy of usability of the coating material. The side plate 1670 may comprise a plastic molded part configured to snap into a cavity of the disc assembly 1600 prior to applying the surface coating or wear material 1680. In some examples, wear material 1680 may be applied both to a contact surface of an outer disc 1620 and the side plate 1670.

Side plate 1670 may be attached to a side surface of disc assembly 1600 via an attachment mechanism 1675, such as one or more press-fit tabs, snap-in pins, and/or bosses. The attachment mechanism 1675 may be configured to attach side plate 1670 to one or more discs of disc assembly 1600. In some examples, attachment mechanism 1675 may be configured to attach side plate 1670 to a core 1640 of disc assembly 1600.

Figure 17:
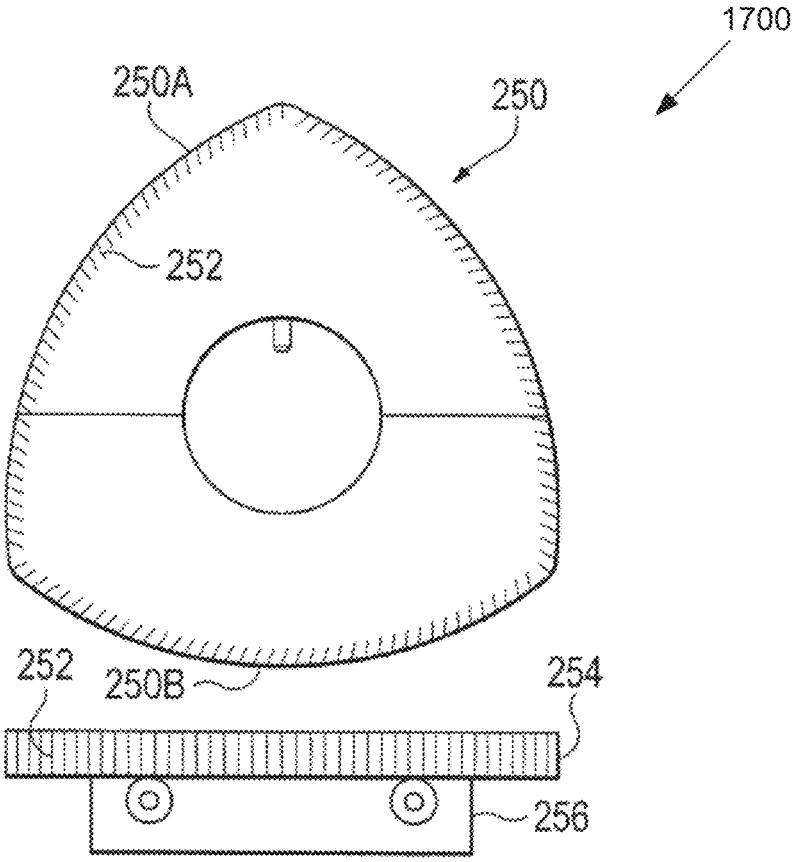
FIG. 17 illustrates an example disc assembly comprising a textured wear surface.

FIG. 17 illustrates an example disc assembly 1700 comprising a textured wear surface 252. Disc assembly 250 may comprise a small disc 256, a large disc 254, and in some examples may comprise upper and lower sections 250A and 250B that attach together around a shaft. The textured wear surface 252 may comprise slits, grooves, bumps, dimples, peening, other textured surfaces, or any combination thereof. In some examples, textured wear surface 252 may comprise siped surfaces including thin slit that are cut in diagonal directions with respect to the outside surface of large disc 254.

The textured wear surface 252 may comprise features which extend some distance from the outside surface toward the center of disc 254. In some examples, textured wear surface 252 may comprise slits or sipping that extend anywhere from around 0.1 inches to 0.5 inches into the exterior contact surface of disc 254. In some examples, the slits may incline in a direction of disc rotation which may provide a serrated rough outside perimeter surface that improves the ability of the disc 254 to grip and carry materials.

In some examples, textured wear surface 252 may be configured to provide an adhering surface for a wear material to be applied to. The surface features may increase the surface area of textured wear surface 252 as compared to a smoot exterior surface, and therefore provide better adhesive characteristics for the wear material.

The textured transport surface 252 may comprise a plurality of grooves arranged in a siped pattern along the outer perimeter of a disc core, and at least a portion of the wear material may be deposited into the plurality of grooves.

The first section 250A of disc assembly 1700 may comprise a first interlocking end and a first coupling end, and the second section 250B may comprise a second interlocking end that interlocks with the first interlocking end and a second coupling end that couples to the first coupling end.

In some examples, wear material may be separately deposited onto the first section 250A and the second section 250B prior to mounting the disc assembly 1700 to the shaft. In other examples, wear material may be deposited onto the disc assembly 1700 after mounting the disc assembly 1700 to the shaft.

In addition to filling in any slits, grooves, or other features of textured wear surface 252, the applied wear material may extend away from the outer contact surface of the disc 254, effectively increasing the outer diameter of the disc assembly 1700. In some examples, the thickness of the wear material which extends out and away from the outer contact surface may be approximately 0.01 inches to 0.5 inches, or more.

In some examples, the outer surface of the disc 254 may be substantially smooth prior to applying the wear material. Instead, the wear material itself may provide the textured wear surface 252. For example, the wear material may be coated onto the contact surface of the disc 254 with a texture and/or spackled finished. The spackled finish of the texture wear material 252 may be achieved by include the texture in a mold or by spraying on the wear material in an uneven or distributed manner.

The textured wear surface 252 may be configured to provide additional friction in certain environmental conditions to move the material through the screen and achieve proper separation. In some examples, the textured spackle may be added to the wear material during an application process by using the same material as the wear material, but applied from a longer distance. For example, the texturing may be completed by holding an application spray device and shooting a light mist so the material settles onto the disc assembly after it has partially dried in the air; creating a textured surface. The textured surface may provide for an approximately 20-30% increase in the coefficient of friction, allowing the screen to be run at higher angles and/or with wet slick materials.

Figure 18:
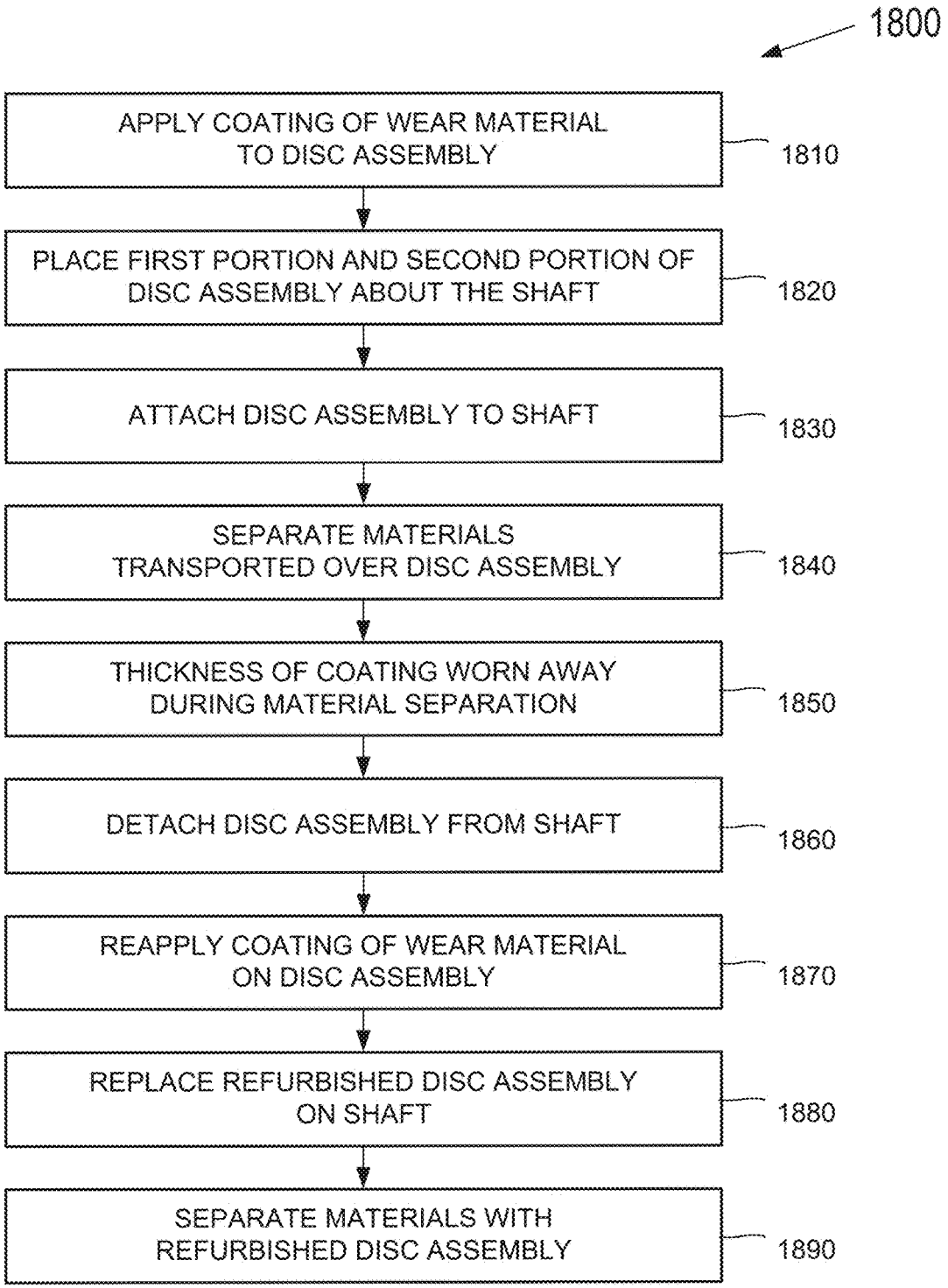
FIG. 18 illustrates an example process of applying a coating of wear material to a reusable disc assembly.

FIG. 18 illustrates an example process 1800 of applying a coating of wear material to a reusable disc assembly. At operation 1810, a coating of wear material may be applied to a disc assembly. In some examples, the disc assembly may comprise first and second portions removably attachable to one another about a shaft.

At operation 1820, the first portion and the second portion may be placed on opposite sides of the shaft. In some examples, the first portion and the second portion may comprise identical halves of the disc assembly.

At operation 1830, the first portion of the disc assembly may be attached to the second portion of a disc assembly in order to mount the disc assembly to the shaft. The disc assembly may comprise a coating of wear material applied to the disc assembly.

At operation 1840, the disc assembly may be operated to separate materials transported over the disc assembly.

At operation 1850, the coating of wear material may be worn away due to contact and friction with the materials being separated at operation 1840.

At operation 1860, the disc assembly may be detached from the shaft in response to a thickness of the wear material being decreased during the material separation operation.

At operation 1870, the coating of wear material may be reapplied on the disc assembly in order to reuse the disc assembly. The disc assembly may comprise a disc core and a textured transport surface extending between a left side of the disc core and a right side of the disc core. In some examples, reapplying the coating may comprise depositing the wear material along an outer perimeter of the disc core, such that the wear material penetrates into the textured transport surface of the disc core.

Additionally, the coating of wear material may comprise a substantially non-rigid wear material that penetrates into the textured surface of a substantially rigid disc core of the disc assembly.

At operation 1880, the refurbished disc assembly may be replace on the shaft, or a different shaft, as described at operations 1820 and 1830.

At operation 1890, the refurbished disc assembly may again be used to separate materials. In other examples, the disc assemblies may be refurbished without removing or otherwise detaching the cores from the shaft. For example, some or all of a sorting screen and/or assembled shaft may be coated with wear material.

Figure 19:
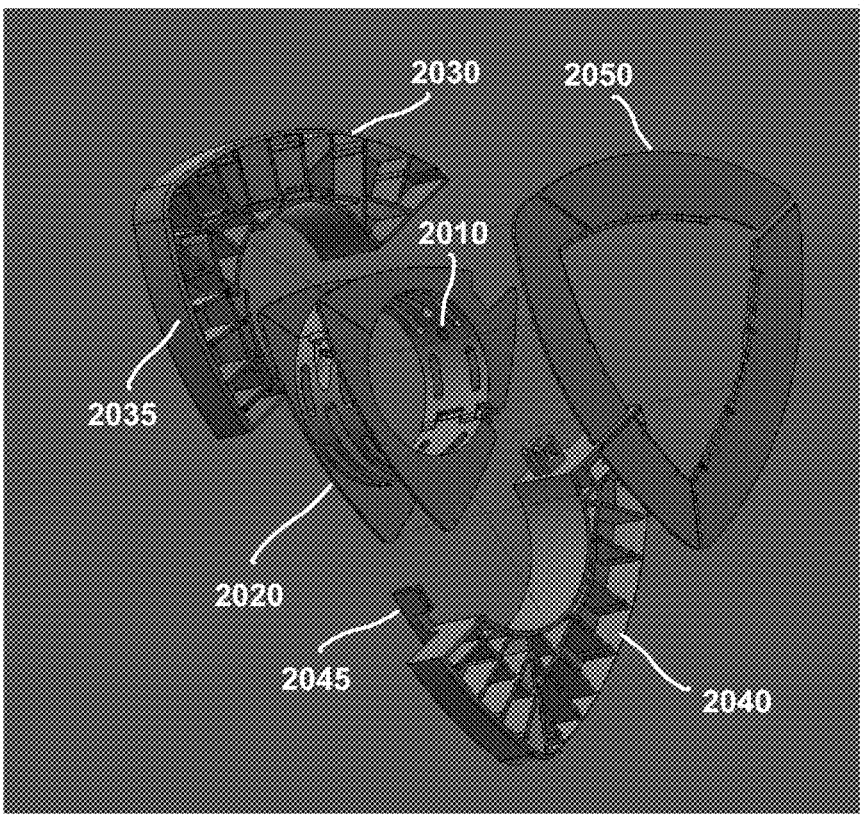
FIG. 19 illustrates an exploded view of an example disc assembly.

FIG. 19 illustrates an exploded view of an example disc assembly 2000, comprising a hub 2020, a first disc portion 2030, and a second disc portion 2040. One or both of first disc portion 2030 and second disc portion 2040 may comprise an attachment mechanism 2045. Attachment mechanism 2045 may be configured to interlock or otherwise attach first disc portion 2030 to second disc portion 2040. For example, attachment mechanism 2045 may be configured to be inserted into a receiving slot or groove of first disc portion 2030. Additionally, one or more bolts may be used to removably attach first disc portion 2030 to second disc portion 2040.

First disc portion 2030 and second disc portion 2040 may be attached to each other around the hub 2020. In some examples, first disc portion 2030 may be configured to mount to an opposite side of the hub 2020 as the second disc portion 2040. The hub 2020 may be mounted to a shaft. Additionally, the hub 2020 may comprise two portions which are removably attached to each other about the shaft, similar to the description of the first disc portion 2030 and the second disc portion 2040. In some examples, the hub 2020 may be secured to the shaft by an attachment device, such as by one or more bolts.

The hub 2020 may be attached to the shaft prior to mounting the first disc portion 2030 and the second disc portion 2040 to the hub 2020. In other examples, one or both of the first disc portion 2030 and the second disc portion 2040 may be mounted to the hub 2020 prior to mounting the hub 2020 to the shaft. Once assembled, the first disc portion 2030 and the second disc portion 2040 may be rigidly attached to the hub 2020, and the hub 2020 may be rigidly attached to the shaft, such that the entire disc assembly 2000 may be configured to rotate as a unitary component when the shaft rotates.

The hub 2020 may comprise a location device 2010 to control the spacing and/or rotational orientation of the disc assembly 2000 relative to the shaft. For example, the location device 2010 may comprise a hole configured to receive a location pin that is welded to the shaft. In other examples, the location device 2010 may comprise a location pin that is inserted into a receiving hole on the shaft.

The hub 2020 may be made out of steel or some other type of rigid material. In some examples, the first disc portion 2030 and the second disc portion 2040 may also be made out of steel. Additionally, one or both of the first disc portion 2030 and the second disc portion 2040 may comprise internal pockets or webbing, rather than being made out of a solid core, in order to reduce the overall weight of the disc assembly 2000 while still maintaining structural support for sorting heavy and/or abrasive materials. Additionally, the core structure may be configured to transfer or receive torque from the shaft.

In some examples, one or more disc covers, such as disc cover 2050, may be attached to the sides of one or both disc portions 2030, 2040, in order to protect the inner surfaces, e.g., pockets, of the core structure. Additionally, in examples in which some or all of the disc assembly 2000 may be coated with a wear material, the disc cover 2050 may comprise a flat surface that is configured to mate with a contact surface 2035 of the disc assembly 2000 to improve adhesion of the wear material to the disc assembly. The wear material may coat or encapsulate both disc portions 2030, 2040, with the disc cover 2050 installed, prior to mounting the disc assembly 2000 to the shaft.

Figure 20:
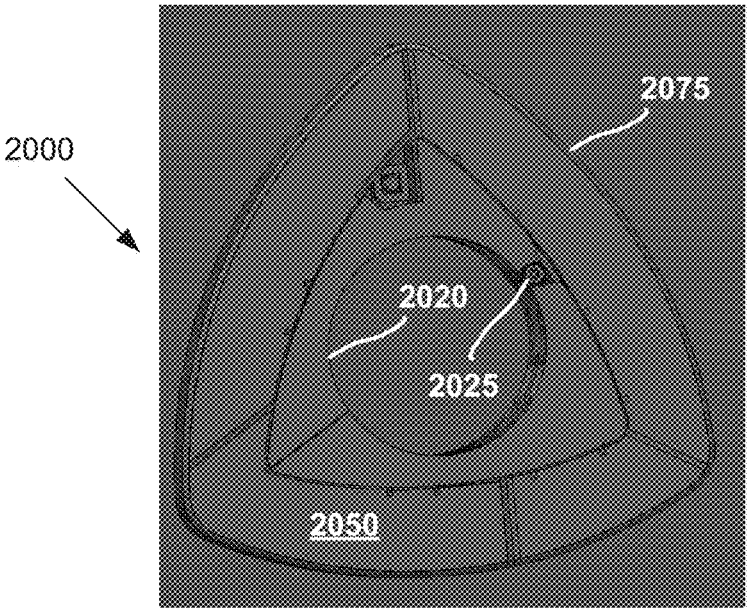
FIG. 20 illustrates the disc assembly of FIG. 19 as assembled.

FIG. 20 illustrates the disc assembly 2000 of FIG. 19 as assembled, such that the first disc portion 2030 and the second disc portion 2040 are combined to form a reusable disc core 2075. When assembled, the disc core 2075 together with the side cover 2050 may give the appearance of a substantially solid disc, such that the internal pockets (FIG. 19) may no longer be visible.

The use of a hinge 2025 in the hub 2020 may be configured to allow for a fastening system that creates tension through compression loading onto the shaft. As discussed above with respect to FIG. 19, the disc core 2075 may be fixed to the hub 2020 using an attachment mechanism such as an interlocking tab design and/or a sliding tab with axial bolt on either side of the disc core 2075. An interlocking tab design may be configured to allow the two portions of the disc core 2075 to fasten to each and other without requiring a bolt or other fastening device associated with the disc core 2075 to penetrate into the hub 2020 itself.

Example Modes of Operation and Wear Materials.

One or more of the disc assemblies disclose herein may be configured as a removable part of a disc screen, which allows the shaft to remain on the frame while the disc assembly is being refurbished and/or recoated with new wear material. The coating or wear material selected for the disc assemblies may be configured to move material up the screen while sizing the material through the screen. Different coating materials may be selected according to their properties, such as how the material reacts to temperature and moisture content of the material being sorted. The re-useable portion of the disc assemblies may comprise an inner core of the disc assembly. These cores may be exposed as coating is worn, allowing the machine operator to identify which discs need to be removed and returned to the manufacture for re-coating. In some examples, one or more portions of discs mounted to the core may also be reusable. In addition to being reusable, one or both of the disc core and the hub may be made of recyclable and/or recycled material.

A multi-diameter disc assembly may comprise a two part assembly that is removable from the screen. The two parts may comprise interlocking features that are configured to attach the two parts to each other and to a shaft. The base components, such as the rigid core and/or hub, may be manufactured from a harder, wear resistant material, such as steel. The coating components or wear material, on the other hand, may be applied through pouring, molding, brushing or spraying a relatively softer material onto the base components.

In some examples, the attributes of the coating components may change durometer and/or toughness based on the material to be processed. The base components can be removed from the material sorting screen and recoated with new wear material when the useable life of the coating is reached.

Additionally, a removable and/or reusable disc assembly may be configured to be changed or use different types of core material as well as coating material, according to different applications, different sorting materials, different operating conditions, or any combination thereof.

For example, when sorting materials that include glass content, both a soft core and a soft coating may be used to allow the glass bottles to go over the screen without breaking. When sorting wet or frozen material, a soft coating with higher coefficient of friction may be selected for the wear material. On the other hand, when sorting large abrasive material, a harder core with a hard coating may be used to add wear life to the disc assembly.

When sorting fiber, a coating may be selected with properties similar to rubber. By way of further illustration, when sorting fine particle size and/or abrasive materials, a reduced core size may be configured to allow for a thicker coating to be applied which may extend the life of the disc assembly. In still other examples, the wear material may comprise a steel spray, a steel coating, a ceramic coating, a glass coating, other types of rigid materials or non-rigid materials, or any combination thereof.

For Construction and Demolition (C&D) or Refuse Derived Fuel (RDF) applications, the disc assemblies may be coated with a wear material comprising a hard/abrasive resistant coating with a low coefficient of friction.

For sorting systems which include separation of glass or ceramic materials, the disc assemblies may be coated with a wear material comprising an extremely hard, low coefficient of friction material, which may be applied in a relatively thicker coating.

For sorting systems which include a Single Stream (SS) or MSW and which operate at ambient temperature, the disc assemblies may be coated with a relatively soft wear material have a coefficient of friction comparable to rubber.

SS/MSW—Cold environments—softest coating better COF than rubber coating

For sorting systems which include a Single Stream (SS) or MSW and which operate in cold or refrigerated temperatures, the disc assemblies may be coated with wear material having a greater coefficient of friction as compared to rubber.

Having described and illustrated the principles of the invention in a preferred embodiment thereof, it should be apparent that the invention may be modified in arrangement and detail without departing from such principles.

The invention claimed is:

1. A disc assembly, comprising:

a substantially rigid disc core including a first section removably attached to a second section and configured to be mounted to a disc screen shaft, wherein the disc core comprises a textured transport surface extending between a left side of the disc core and a right side of the disc core; and a replaceable coating of wear material that is deposited only along an outer perimeter of the disc core and that penetrates into the textured transport surface, while leaving the left side and right side of the disc core uncoated.

2. The disc assembly of claim 1, wherein the textured transport surface comprises a grooved recess located in the outer perimeter of the disc core, and wherein at least a portion of the wear material is deposited into the grooved recess.

3. The disc assembly of claim 2, wherein the grooved recess comprises a channel centrally located along the outer perimeter of the disc core and formed between two parallel ribs of the textured transport surface.

4. The disc assembly of claim 3, wherein the wear material is additionally deposited on the two parallel ribs.

5. The disc assembly of claim 1, wherein the textured transport surface comprises a plurality of grooves arranged in a siped pattern along the outer perimeter of the disc core, and wherein at least a portion of the wear material is deposited into the plurality of grooves.

6. The disc assembly of claim 1 wherein the first section comprises a first interlocking end and a first coupling end, and wherein the second section having a second interlocking end that interlocks with the first interlocking end and a second coupling end that couples to the first coupling end.

7. The disc assembly of claim 6, wherein the wear material is separately deposited onto the first section and the second section prior to mounting the disc core to the shaft.

8. The disc assembly of claim 6, wherein the wear material is deposited onto the disc assembly after mounting the disc core to the shaft.

9. A disc assembly, comprising:

a first disc including a first transport surface located along an outer perimeter of the first disc and associated with a first diameter;

a second disc having a second diameter and including a transport surface extending between a left side of the second disc and a right side of the second disc, wherein the second diameter is larger than the first diameter; and a replaceable coating of textured wear material that is deposited only along the outer perimeter of the second disc transport surface, while leaving the left side and right side of the second disc uncoated.

10. The disc assembly of claim 9, wherein the second disc is separately attachable to a shaft from the first disc, and wherein the first disc abuts up against a side of the second disc after the disc assembly is attached to the shaft.

11. The disc assembly of claim 10, wherein the textured wear material is deposited on both the first disc and the second disc after the disc assembly is attached to the shaft.

12. The disc assembly of claim 9, wherein the transport surface comprises a channel located in the outer perimeter of the second disc, and wherein at least a portion of the textured wear material is deposited into the channel.

13. The disc assembly of claim 12, wherein the channel is centrally located along the outer perimeter of the second disc and is formed between two parallel ribs of the transport surface, and wherein the textured wear material is additionally deposited on the two parallel ribs.

14. The disc assembly of claim 9, wherein the transport surface comprises a plurality of grooves arranged in a diagonal configuration around the outer perimeter of the second disc, and wherein at least a portion of the textured wear material is deposited into the plurality of grooves.

15. A method, comprising:

attaching a first portion of a disc assembly to a second portion of a disc assembly in order to mount the disc assembly to a shaft, wherein the disc assembly comprises a coating of wear material applied to the disc assembly;

separating materials transported over the disc assembly, detaching the disc assembly from the shaft in response to a thickness of the wear material being decreased during material separation; and reapplying the coating of wear material on the disc assembly in order to reuse the disc assembly, wherein the wear material is deposited only along an outer perimeter of the disc assembly, while leaving a left side and right side of the disc assembly uncoated.

16. The method of claim 15, wherein the disc assembly comprises a disc core and a transport surface, the transport surface extending between a left side of the disc core and a right side of the disc core and defining the outer perimeter, wherein reapplying the coating comprises depositing the wear material along the outer perimeter of the disc core, and wherein the wear material penetrates into the transport surface.

17. The method of claim 16, wherein the coating of wear material comprises a substantially non-rigid wear material that penetrates into the surface of a substantially rigid disc core of the disc assembly.

* * * * *